US012507807B1

(12) United States Patent
Rosenberg

(10) Patent No.: US 12,507,807 B1
(45) Date of Patent: Dec. 30, 2025

(54) SITTING AND KNEELING CHAIR APPARATUS AND METHODS

(71) Applicant: Marc Rosenberg, Deerfield, IL (US)

(72) Inventor: Marc Rosenberg, Deerfield, IL (US)

( * ) Notice: Subject to any disclaimer, the term of this patent is extended or adjusted under 35 U.S.C. 154(b) by 188 days.

(21) Appl. No.: 18/408,514

(22) Filed: Jan. 9, 2024

Related U.S. Application Data

(60) Provisional application No. 63/438,045, filed on Jan. 10, 2023.

(51) Int. Cl.

| | |
|---|---|
| ***A47C 9/00*** | (2006.01) |
| ***A47C 1/024*** | (2006.01) |
| ***A47C 7/50*** | (2006.01) |
| ***A47C 9/02*** | (2006.01) |

(52) U.S. Cl.
CPC ..... *A47C 9/005* (2013.01); *A47C 1/024* (2013.01); *A47C 7/506* (2013.01)

(58) Field of Classification Search
CPC ..... A47C 9/005; A47C 7/506
See application file for complete search history.

(56) References Cited

U.S. PATENT DOCUMENTS

| | | | | |
|---|---|---|---|---|
| 4,589,699 | A | 5/1986 | Dungan | |
| 4,650,249 | A | 3/1987 | Serber | |
| 4,765,684 | A | 8/1988 | Kvalheim et al. | |
| 5,401,078 | A * | 3/1995 | Riach | A47C 7/503 297/423.11 X |
| 5,542,746 | A * | 8/1996 | Bujaryn | A47C 9/005 297/423.12 X |
| 5,667,278 | A * | 9/1997 | Li | A47C 9/005 297/423.11 |
| 6,065,808 | A * | 5/2000 | Tinsley | A61G 15/007 297/423.11 X |
| 7,144,080 | B2 * | 12/2006 | Lloyd | F16C 11/103 297/423.12 X |
| 7,946,972 | B2 | 5/2011 | Guissin et al. | |
| 9,205,008 | B2 * | 12/2015 | Meiki | A61G 7/015 |
| D803,589 | S | 11/2017 | Rehkemper et al. | |
| 10,117,510 | B2 | 11/2018 | Rehkemper et al. | |
| 11,730,269 | B1 * | 8/2023 | Rosebrook | A47C 7/5064 297/423.12 |
| 11,805,919 | B1 * | 11/2023 | Raiszadeh | A47C 9/005 |
| 2007/0063569 | A1 | 3/2007 | Mays | |
| 2009/0140567 | A1 * | 6/2009 | Weiss | A47C 7/5068 297/423.12 |
| 2013/0307298 | A1 * | 11/2013 | Meiki | A61G 5/10 297/68 |
| 2024/0041215 | A1 * | 2/2024 | Spong | A47C 1/03255 |
| 2025/0256014 | A1 * | 8/2025 | Boddie | A47C 7/68 |

* cited by examiner

*Primary Examiner* — Rodney B White
(74) *Attorney, Agent, or Firm* — Perry Hoffman

(57) ABSTRACT

Sitting and kneeling chair allowing quick and frequent transition between two core configurations, between at least sitting and kneeling positions with adjustability, without leaving the chair. Knee pads have inverting knee assembly with front and rear ends, that uses a knee pad pivot, follower, and knee linkage coupling with and upper portion of a frame below the seat assembly for travel between the upper portion of the frame and the lower portion of the frame above a base where each knee pad may be deployed from and between deployed and inverted orientations.

20 Claims, 33 Drawing Sheets

SITTING AND KNEELING CHAIR APPARATUS AND METHODS

CROSS-REFERENCE TO RELATED APPLICATION

This application claims priority pursuant to 35 U.S.C. 119 (e) to U.S. Provisional Application No. 63/438,045 filed on Jan. 10, 2023.

FIELD OF THE INVENTION

This invention relates generally to an adjustable kneeling chair apparatus, system and methods providing ergonomic solutions offering both kneeling and sitting options, for office desk chair, as well as eSport athletics better performing to readily transition between at least sitting and kneeling positions with adjustability, and accessories accommodations.

BACKGROUND OF THE INVENTION

Applicant's inventions facilitate an adjustable kneeling chair apparatus, system and methods shown herein. Mobile lifestyles have expanded types of workspaces in comparison to past conventional settings. People seek comfort for the hours they spend working each day as well as portability. Typical office desk chair apparatus may not provide users with feasible adjustability, transport, storage, or use options. Office chairs are rarely ergonomically optimized for the person.

Several patents relating to chairs and seats include:

Kvalheim et al, U.S. Pat. No. 4,765,684 discloses a multi-purpose chair with a retractable knee rest as a typical office chair with attachments and adjustments to provide a knee rest normally positioned beneath the seat cushion.

Serber U.S. Pat. No. 4,650,249 discloses an ergonomic seating assembly system with front chest support, pelvic tilt seat component and various attachments to the assembly to allow adjustment of the position of the buttocks of the person in relation to the natural position of the spine for a given generally fixed position of the person's torso.

U.S. Pat. No. 4,589,699 to Dungan. In addition to a separate angular tilting arrangement for the seat and knee rest, this patent covers the feature of a variation in lateral space between the seat and knee rest members as an improvement over the prior art.

Along with the exploding popularity of eSports comes injuries as a result of long hours spent training for excellence. The longer the hours, the more strain is placed on back, neck, and those all-important arms and hands. Advantageously the herein disclosed all-in-one eSports player station is adjustable and customizable to provide players with the most comfort-forward, focused, personal gaming environment. Realizing the need for a better way to sit kneel, work or play, novel sitting, and kneeling chair apparatus are disclosed with Applicant's systems and methods address these challenges. With several points of adjustment, players can customize the fit to their needs and experience a new level of comfortable as they play.

The contents of U.S. Design Pat. No. D803,589 for "Desk System" published Nov. 28, 2017, and U.S. Pat. No. 10,117,510 for "Portable Adjustable Desk System" published Nov. 6, 2018 are hereby incorporated into the presented disclosure by reference in their entirety.

The disclosed eSports sitting and kneeling office chair apparatus mechanisms and methods advantageously, in a reconfigurable system which overcomes problems of the prior art.

SUMMARY OF THE INVENTION

In accordance with the present inventions, advantageous systems, methods, sitting, kneeling, and chair apparatus are provided in the form of novel sitting and kneeling chair disclosures herein combines otherwise seemingly traditional seating as well as a posture neutral kneeling chair capability. Users may quickly and frequently transition between the two core configurations, in seconds, without leaving the chair.

Briefly summarized, the inventions relate to a knee assembly connected under a first knee pad, the first inverting knee assembly having a front end and a rear end, the first inverting knee pad assembly having a first knee pad pivot at the front end of the first inverting knee assembly and a first knee pad follower at the rear end of the first inverting knee assembly, the knee linkage coupling the first knee pad pivot with the upper portion of the frame support structure below the seat assembly, with the first knee pad follower at the frame support pathway for travel between the upper portion of the frame support structure and the lower portion of the frame support structure above the base.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

FIG. 6C has lever handle released to allow tilting function, where FIG. 6D initiates Seat Tilt Return;

DETAILED DESCRIPTION OF THE EMBODIMENTS

The novel sitting and kneeling chair disclosures herein combines otherwise seemingly traditional seating as well as a posture neutral kneeling chair capability. Users can quickly and frequently transition between the two core configurations, in seconds, without leaving the chair. The backrest is height adjustable; the arm rests have 4 axes of freedom, and the knee pads can be adjusted to suit the user. A particular advantage of the sitting and kneeling chair apparatus, system and methods relate to the user's unique ability to control multiple setting to achieve the desired comfort and postural feeling they desire. This is accomplished through multiple adjustment devices, unique geometry and a "Core Engaging" tilting seat to relieve back pressure as well as allow the user to constantly change their positioning easily to ensure they are not forced to always sit in one position.

Figure 1:
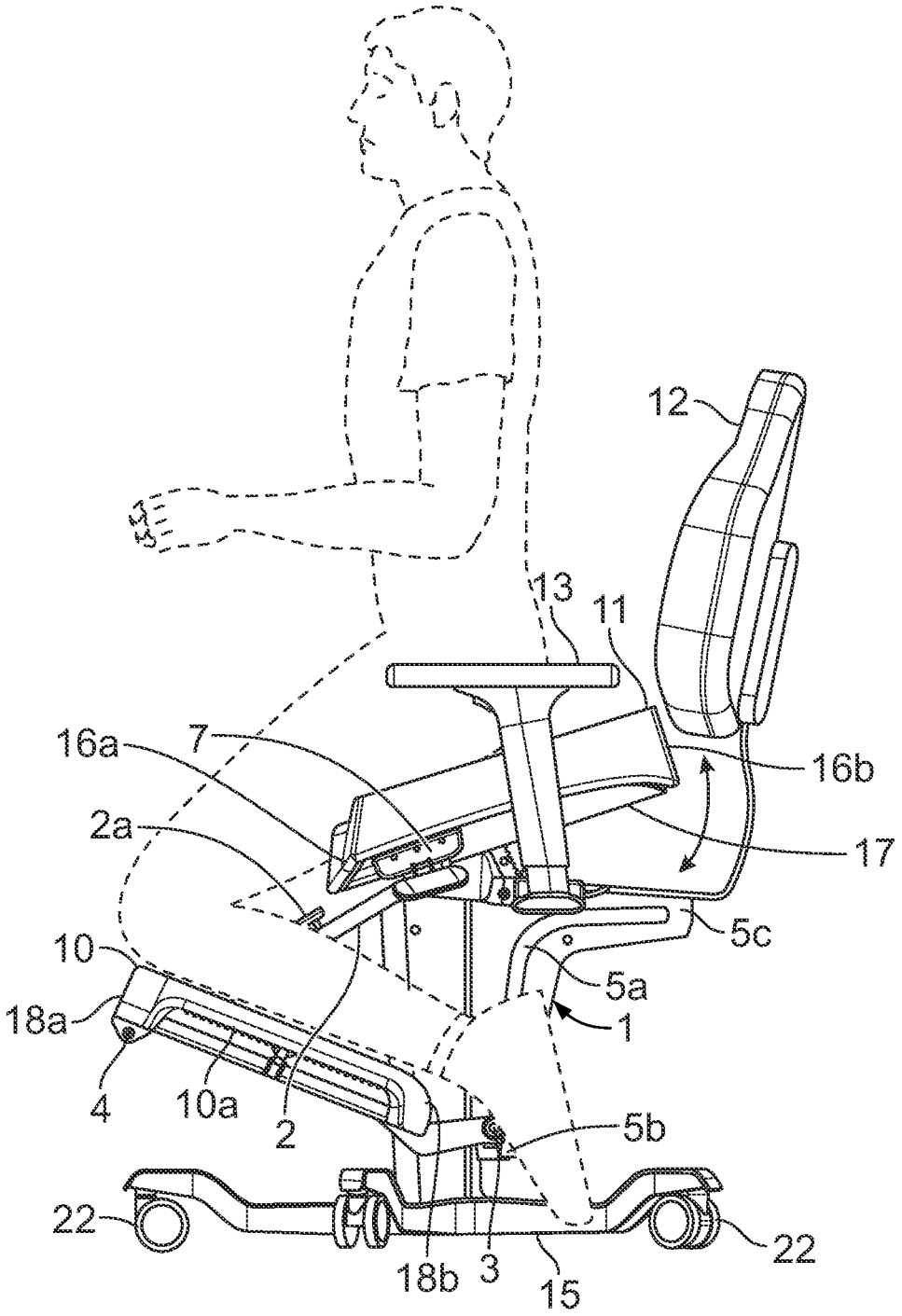
FIG. 1 show the adjustable portable sitting and kneeling chair system, as a dynamic, highly adjustable ergonomic solution that offers both kneeling and sitting options, with novel features advancing the gaming furniture and peripheral market offering to serious casual gamers, and eSport athletes perform better and longer.

FIG. 1 shows an adjustable portable sitting and kneeling chair system, with highly adjustable ergonomic solution that offers both kneeling and sitting options. Kneeling chairs allow the spine to maintain its natural curve more easily, and moreover offers both kneeling and sitting options allows for regular changes in position so as to reduce the risk of lower back pain with the adjustable portable sitting and kneeling chair system of FIG. 1 making it easy to change positions frequently, relieving stress on the back. FIG. 1 illustrates the Seated Position in an adjustable portable sitting and kneeling chair system for both kneeling and sitting options. FIG. 1 represents the chair in its Kneeling Mode with seat 11 in the tilted up position resting users' bottom gently forward. The kneepads (10) are in the deployed position so that the users' knees would be kneeling. In this use, the users back would have a reduced load as their weight would be distributed between their knees and bottom reducing the stress on the back.

Figure 2A:
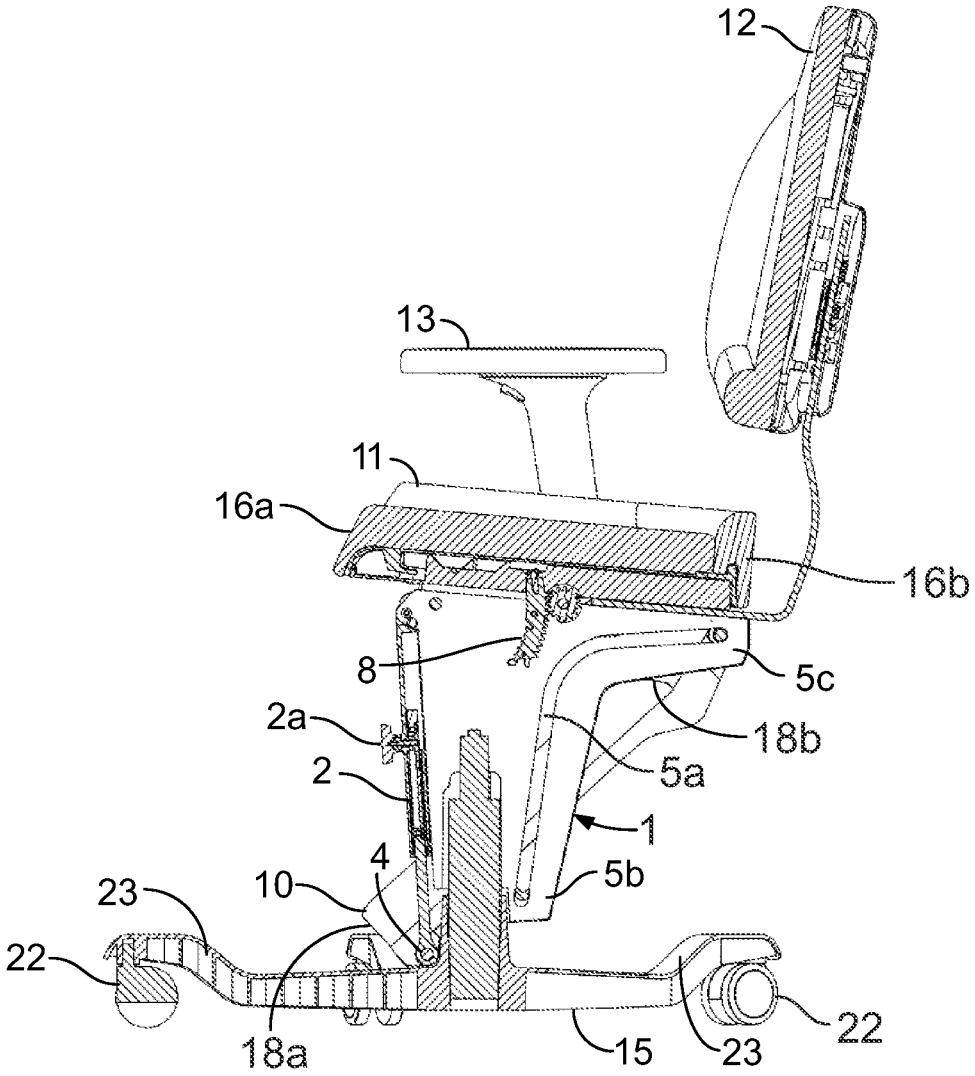
FIGS. 2A-2D illustrates the sitting and kneeling chair Seated Position being adjustable, with Knee Deploy Transition operations.
Figure 2B:
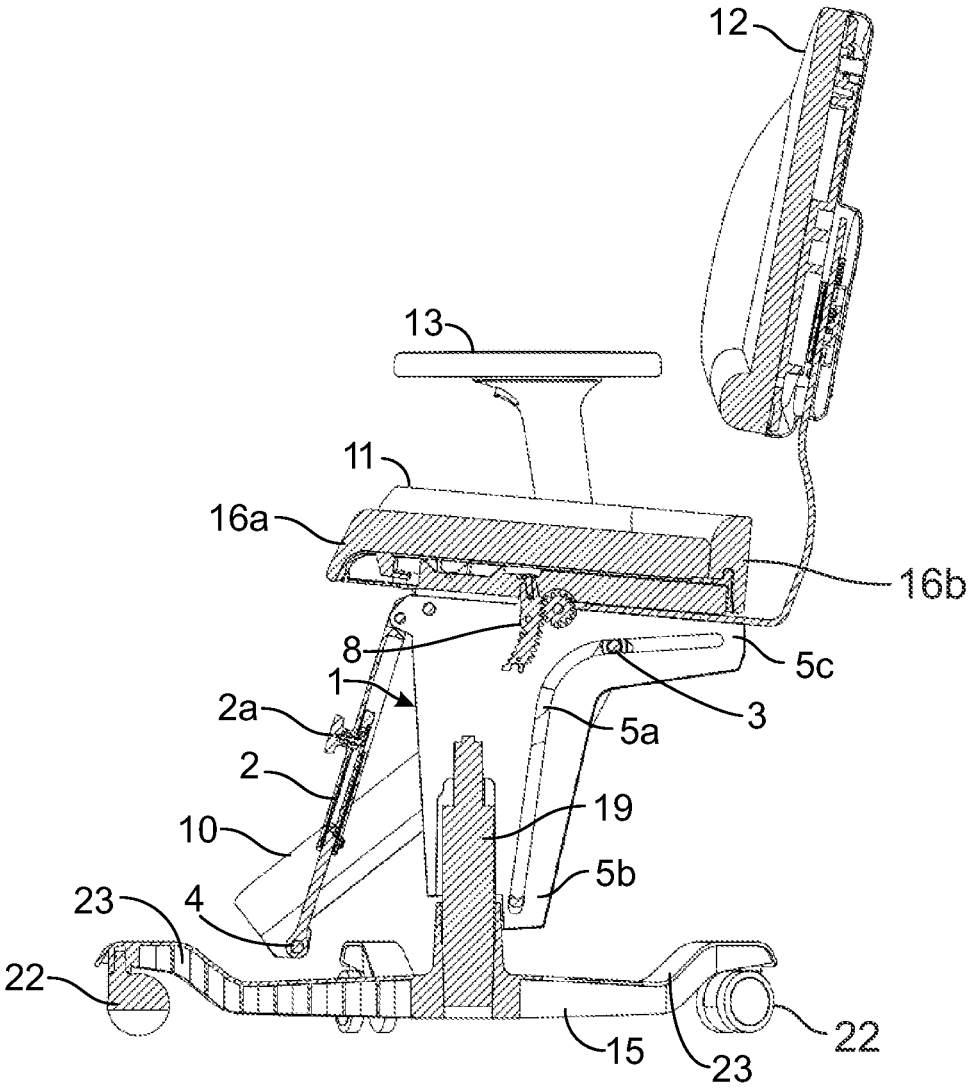
Figure 2C:
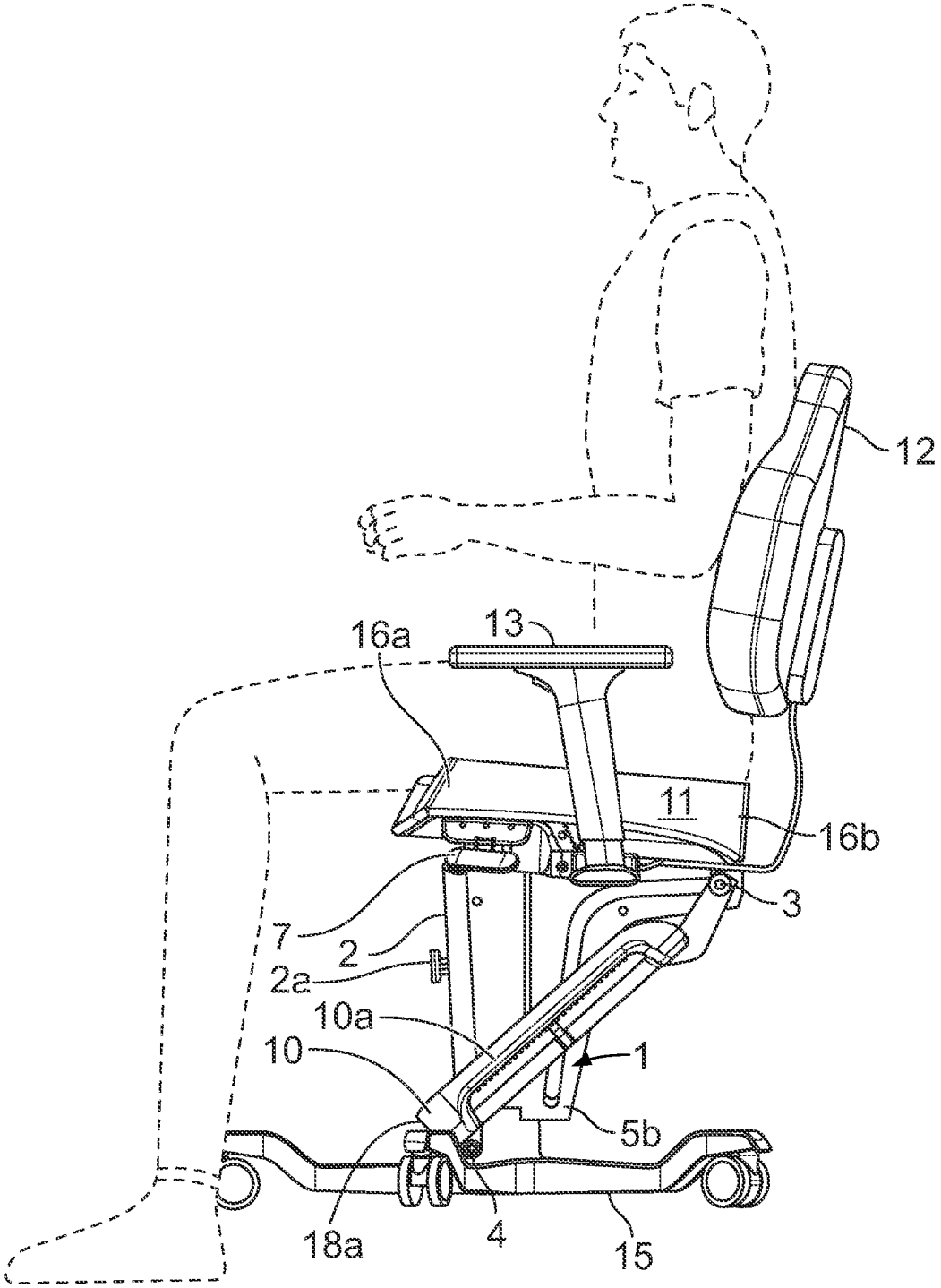
Figure 2D:
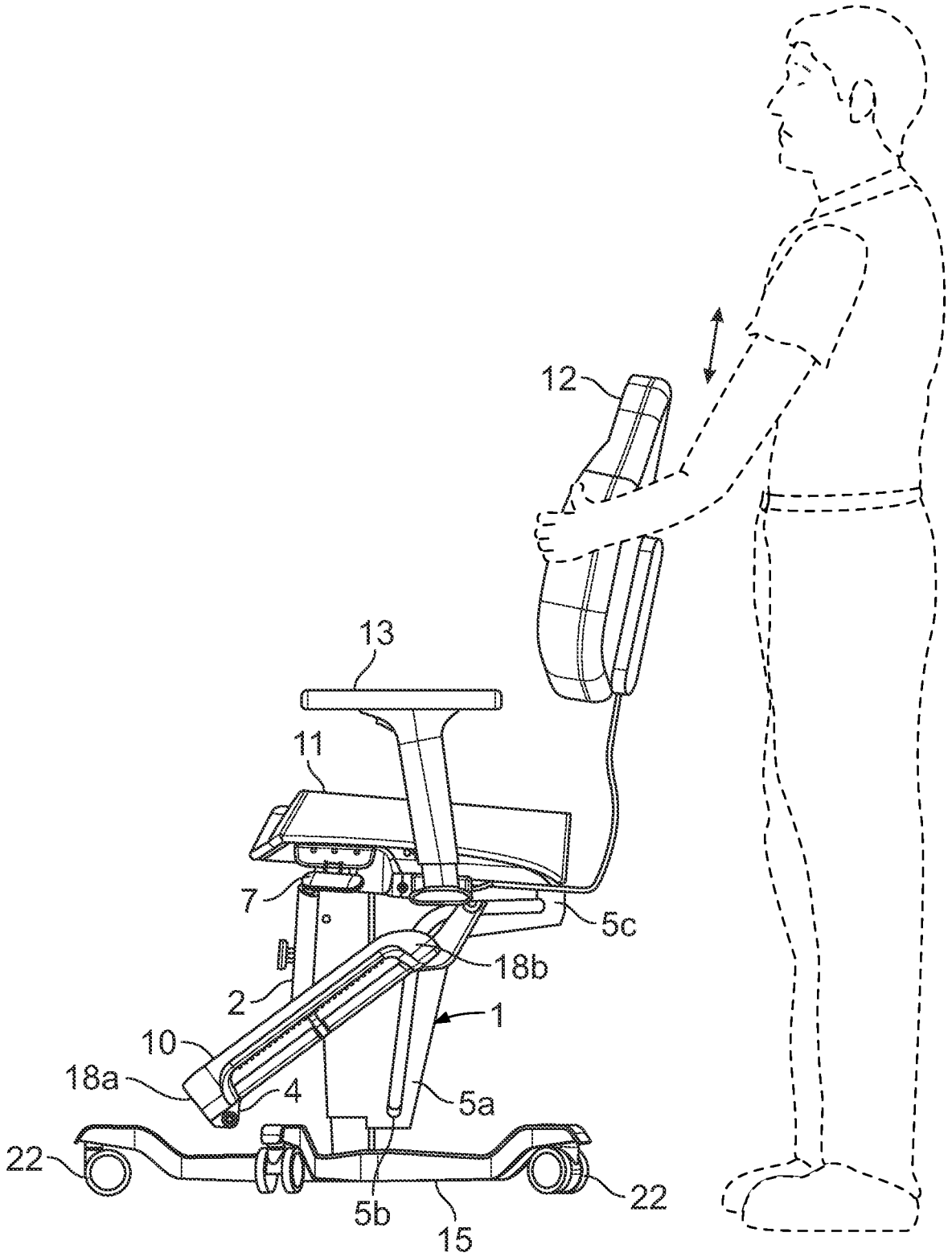

With reference to FIGS. 2A-2D and particularly FIGS. 2C-2D the sitting and kneeling chair Seated Position is adjustable. FIGS. 1, 2A, 2B and FIGS. 3A-3C Knee Deploy Transition operations stages of Knee Deploy Transition operations are shown. FIGS. 1 and 3D illustrate the sitting and kneeling chair in its Kneeling Position. Traditional Seating Mode FIG. 2C Storing Position moved into highest inverted storage. The sitting and kneeling desk chair apparatus, e.g., FIGS. 1, 2C, and 3D include a seat cushion 11 having a front portion 16*a* and a rear portion 16*b*, and a seat assembly 17 connected under the seat cushion 11. A frame support structure 1, or EXO frame supports and facilitates operating functions with added strength supporting the sitting and kneeling desk chair apparatus. The EXO frame support structure 1 is provided below the seat assembly 17 supporting knee pad followers 3 at the frame support pathway 5*a* for travel between a lower portion 5*b* (Lower Knee Stop) and an upper portion 5*c* (Upper Knee Stop) of EXO frame support structure 1 with frame support structure above a base 15 is located below the EXO frame 1 supporting the seat assembly 17. Knee pads 10 provide rest knees on in Kneeling position. Base 15 is an inverted 5 Star Base allowing movement for Exo frame 1. The chair rolls as is typical for task and office chairs on casters that are part of the 5-Star Base (herein inverted for Low Profile clearance) unique to the sitting and kneeling chair apparatus for lower clearance for the knee pads to stow and deploy without interference. The short cross section and low floor clearance are unique as the typical 5-star base is larger and taller. The Low Profile 5-Start Base main supports 23 have been lowered to allow for the kneeling mechanism to actuate and deploy or retract without the base interfering with the motion, while allowing full movement of locking casters, or wheels 22.

Figure 5A:
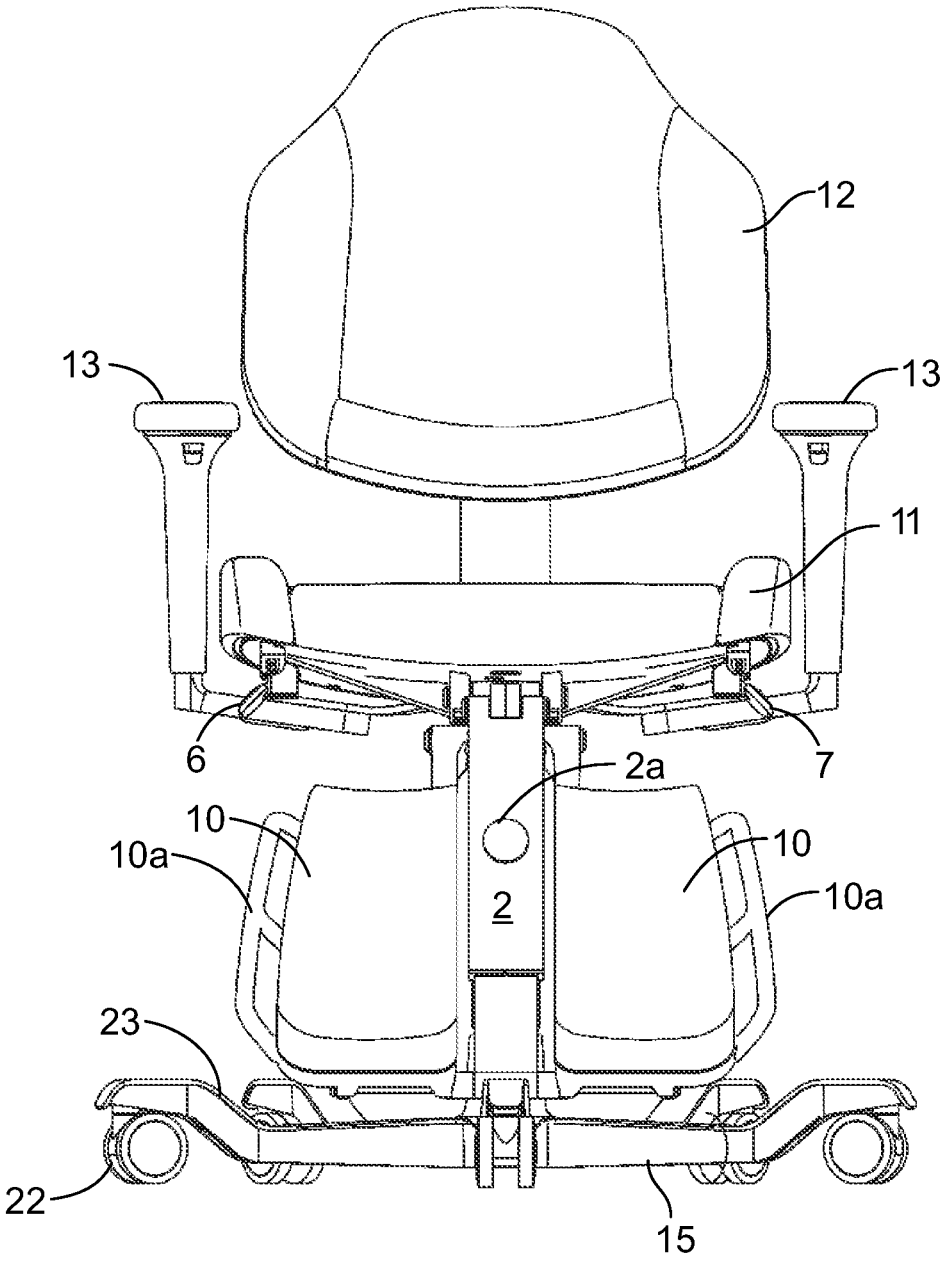
FIGS. 5A, 5B and 5C illustrate Seat Height Touch Points, with operating elements of FIGS. 5D and 5E adjusting Seat Tilted for Kneeling, where FIGS. 5F and 5G adjust positioning the Seat for Standard Seating from FIG. 5H internal mechanisms to the Frame track system created to move the user from a traditional seated position to kneeling.
Figure 5B:
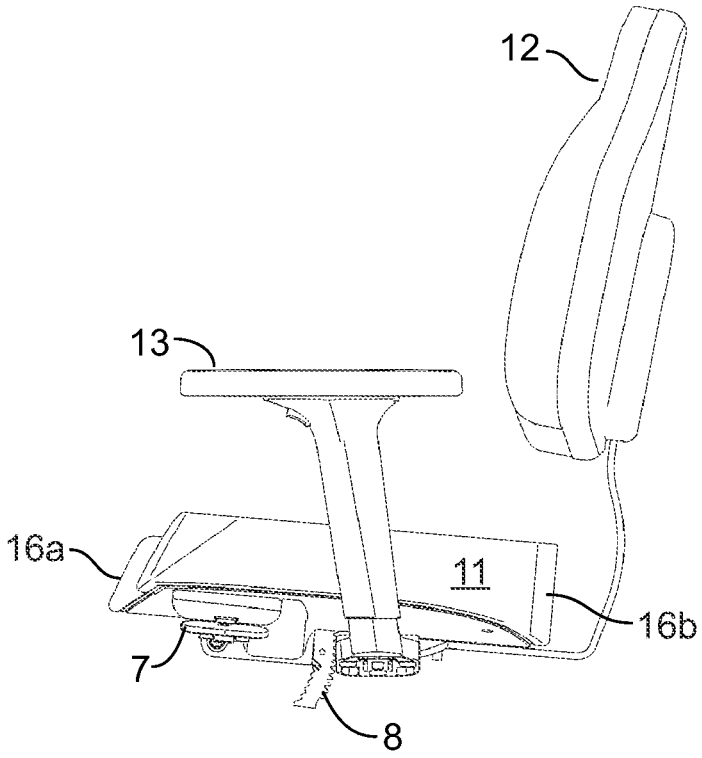
Figure 5C:
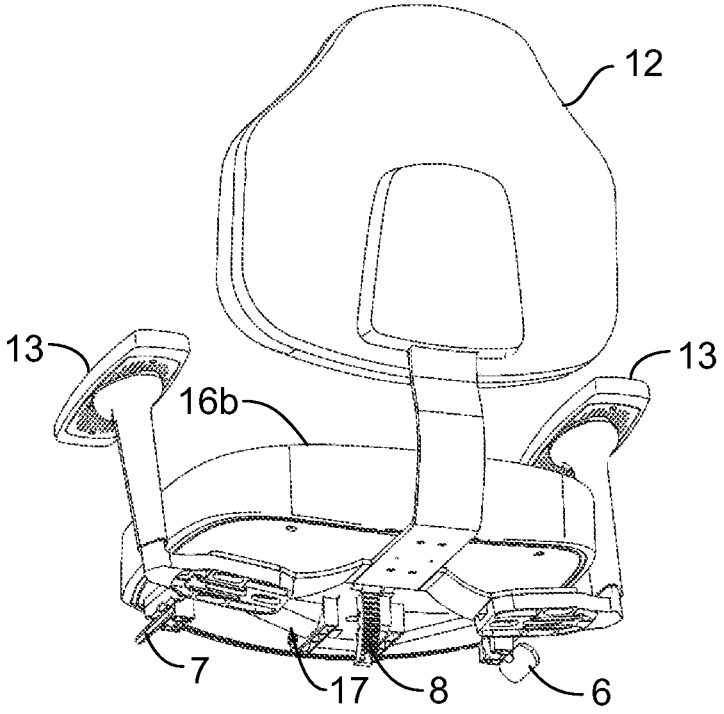

An adjustable telescoping height element 19 at EXO frame 1 adjusts chair height is adjusted via the Height Adjust Lever handle 6 which raises and lowers the chair assembly as is typical for task and office chairs via a hydraulic cylinder 19. The seat assembly 17, arm rests 13, Backrest 12 with the Exo Frame 1), and Knee Pads 10 all move together via the Height Adjust Cylinder 19. Seatback Backrest 12 raises and lowers to users' preference mounted on the J-arm shown in FIG. 2D. The back rest 12 is height adjustable relative to the Exo-Frame 1 via a Backrest Height Adjustment Mechanism. Lifting the back will ratchet to higher positions until the highest is reached and then returns to the bottom position. The back rest may facilitate unique sizing with shapes offering will lumbar support. Adjustable armrests 13 provide four (4) axes of freedom with forward and back 360 degree turning adjustable such that the pads can be raised or lowered, shifted forward to back, in and out/rotate allowing the user to move the rests to 90 degrees when tilted forward into kneeling. FIGS. 5A, 5B and 5C facilitate Seat Height Touch Points; Back height adjustment, (see FIG. 2D) user hold by hand at each side and move up the back, if move down, need to move up to the highest then can go down. Base 15 receives and supports the adjustable height element 19 above a substantially horizontal floor surface for raising and lowering said frame support structure 1 and seat assembly 17, with the frame support structure 1 having a lower portion located above the base 15.

A first knee pad 10 has a front portion 18*a* and a rear portion 18*b* for a deployed orientation where the front portion 18*a* is above the rear portion 18*b* with the front portion 18*a* extending outwardly from the frame support structure 1, and an inverted orientation where the front portion 18*a* is below the rear portion 18*b* for storage with the front portion 18*a* near the base 15 and the rear portion 18*b* alongside the frame support structure 1 and below the seat assembly 17. A second knee pad 10 likewise has a front portion 18*a* and a rear portion 18*b*. An adjustable knee link, knee linkage 2, forward linkage to Knee Pad Pivot 4 at top end of knee cushion 18*a* is manually controlled and set with knob 2*a* as discussed herein. The frame support pathway 5*a* of the frame support structure 1 is inset establishing an Inverted pathway channel with a curved partial radius on each side of the EXO frame 1 for slotted captured pin movements directs/coupling ends captured at Knee Pad Followers 3 herein for Inverted stowed, and lowered Deployed positions.

First and second inverting knee assembly Knee Pad Followers 3 and Knee Pad Pivots 4 connected under the knee pads 10, with first inverting knee assembly having front end 18*a* and rear end 18*b*, with first inverting knee pad assembly having its first knee pad pivot 4 at the front end 18*a* and its first knee pad follower 3 at its rear end 18*b* of the first inverting knee assembly. The knee linkage 2 has an extension arm 24 that couples with the first knee pad pivot 4, with extension adjustment arm 24 that raises and lowers to selected position. The knee linkage 2 connects at the upper portion of said frame support structure 1 below the seat assembly 17, with the first knee pad follower 3 at the frame support pathway 5*a* for travel between the upper portion 5*c* of frame support structure 1 and the lower portion 5*b* of frame support structure 1.

The second inverting knee assembly having front end 18*a* and rear end 18*b*, with second inverting knee pad assembly having its second knee pad pivot 4 at the front end 18*a* and its second knee pad follower 3 at its rear end 18*b* of the second inverting knee assembly. The knee linkage 2 has an extension 24 that couples with the second knee pad pivot 4, and the knee linkage 2 connects at the upper portion of said frame support structure 1 below the seat assembly 17, with the second knee pad follower 3 at the frame support pathway 5*a* for travel between the upper portion 5*c* of frame support structure 1 and the lower portion 5*b* of frame support structure 1.

Assembly Knee Pads 10 may each be provided with handles 10*a* includes as first and second knee pad handles, however the knee pads 10 are sufficiently wise so as to provide grip at sides thereof, with the inverting knee assemblies alternately positioning the each knee pad between the deployed orientation and the inverted orientation with each knee pad follower 3 traveling between the pathway portions 5*a*, 5*b*, 5*c* channel sections of the frame support structure 1. Herein EXO Frame 1 provides a connection point for the linkages and all major systems of the sitting and kneeling chair, and the EXO Frame 1 also houses the cam track to control the path of the back of the knee pads. With reference to the exploded view of FIG. 8, it will be appreciated that the EXO Frame 1 is provided as two (2) complementary housings which may be metal cast molded, machine formed, or injection molded using materials such as Aluminum, carbon fiber, or plastics, and the like.

Figure 3A:
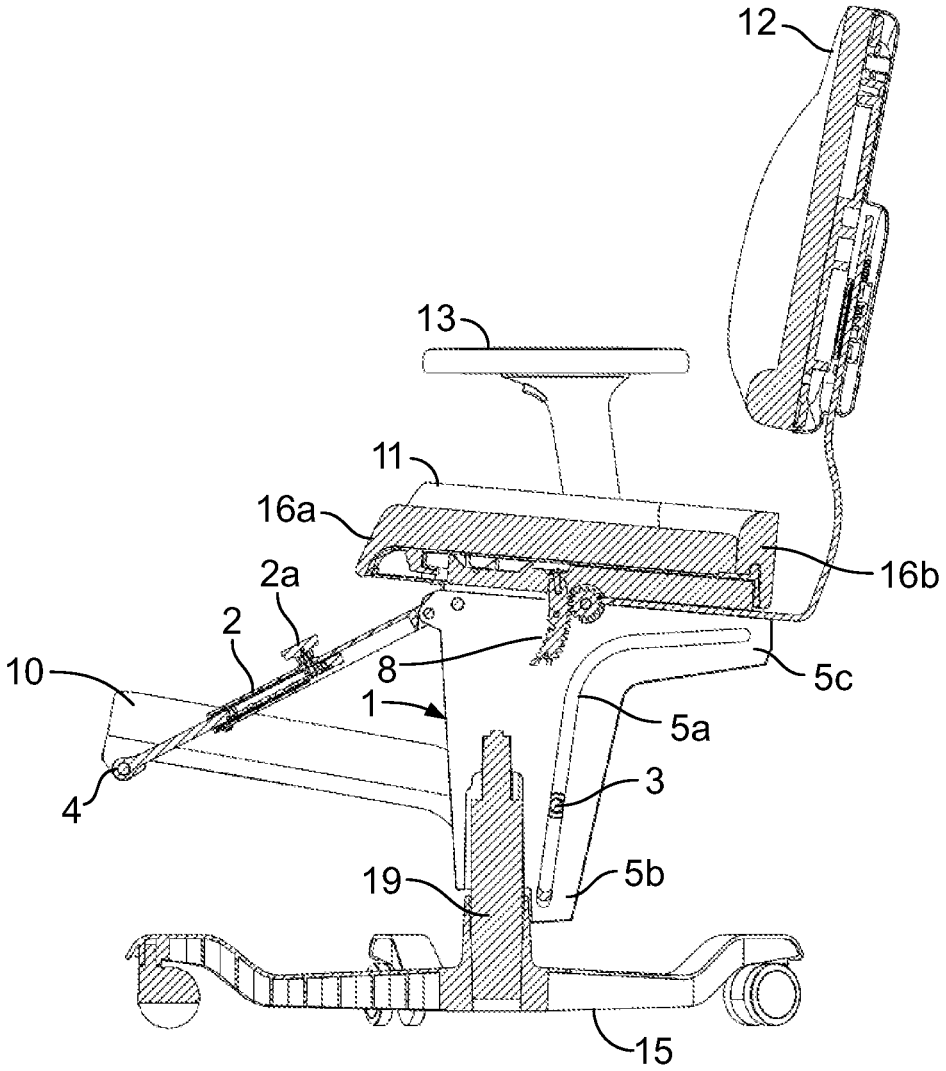
FIGS. 3A-3C illustrates Knee Deploy Transition operations with FIG. 3D showing the sitting and kneeling chair in its Kneeling Position.
Figure 3B:
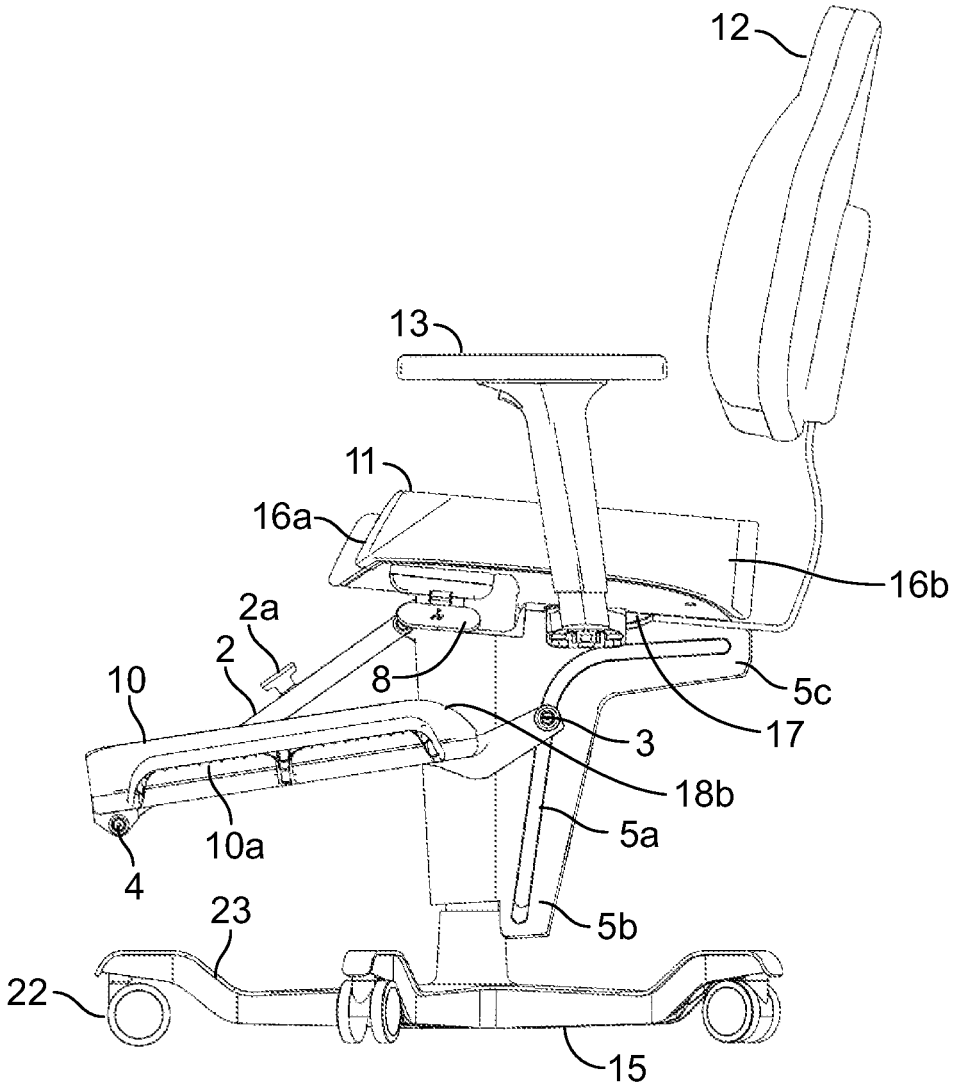
Figure 3C:
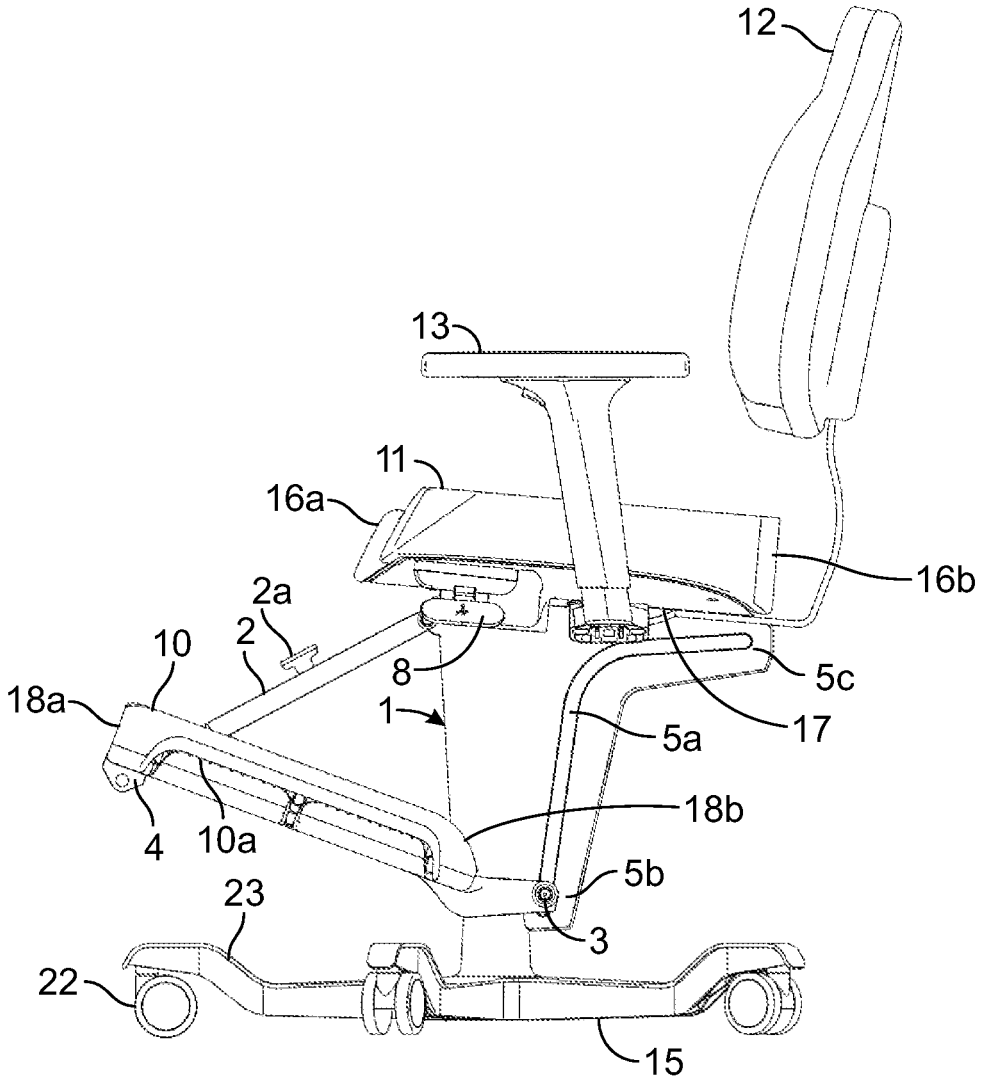
Figure 3D:
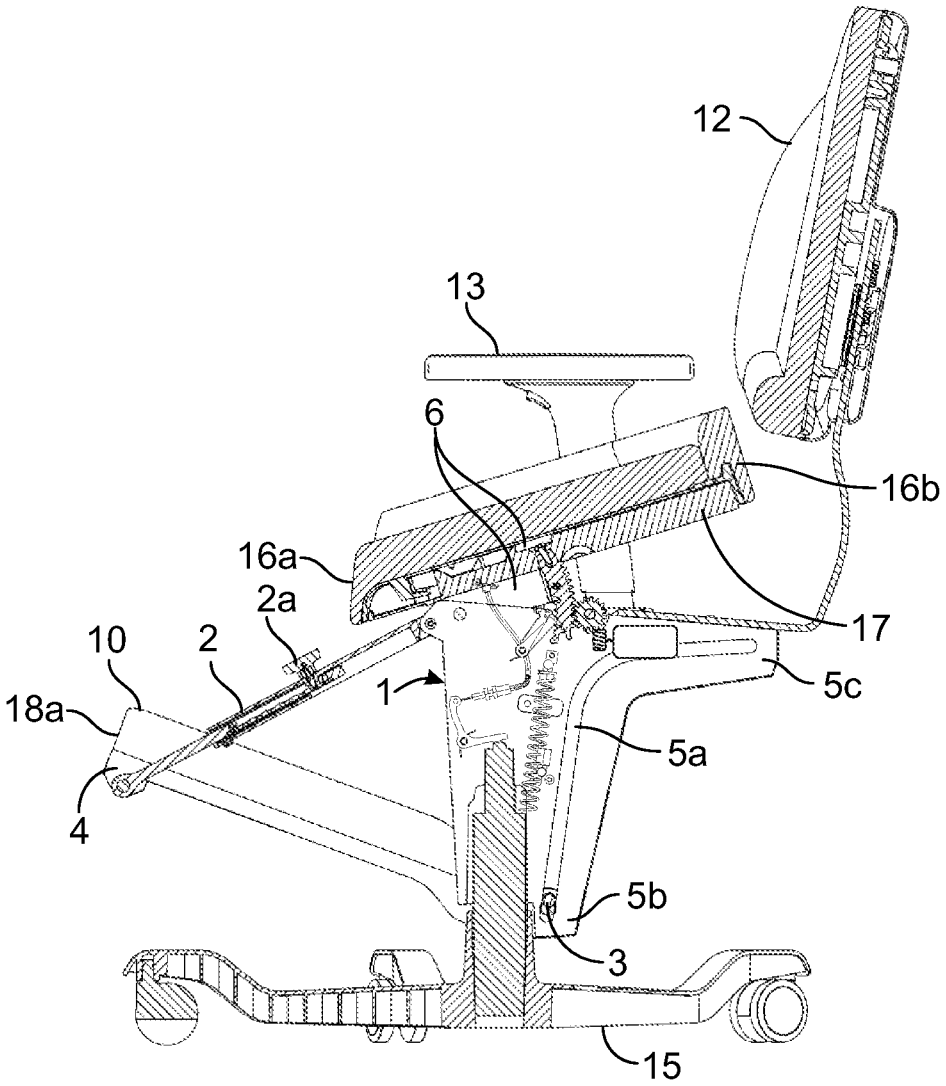
FIG. 3E illustrates Knee Fit Lower Stop in kneeling mode prior to seat bottom being tilted. Kneepads Deployed.
FIGS. 3F and 3G illustrate seat up and down functions, pulling the Seat handle Height Mechanism to adjust the seat height.
FIG. 3H illustrates automated mechanisms including motor, gear train sequencing intended user operations/motorized use with electronic motor mounted in an alternate frame structure.
FIGS. 3I and 3J illustrate seat tilting angled up and down functions, pulling the Seat handle Tilt Mechanism to adjust the seat tilt.
FIGS. 3K, 3L, 3M illustrate Knee pad movement where holding the handles by two hands and move the Knee pad linkage with adjustable adjustment by pulling handle knob to move the knee pad 10 up and down to adjust according to personal needs.
Figure 3E:
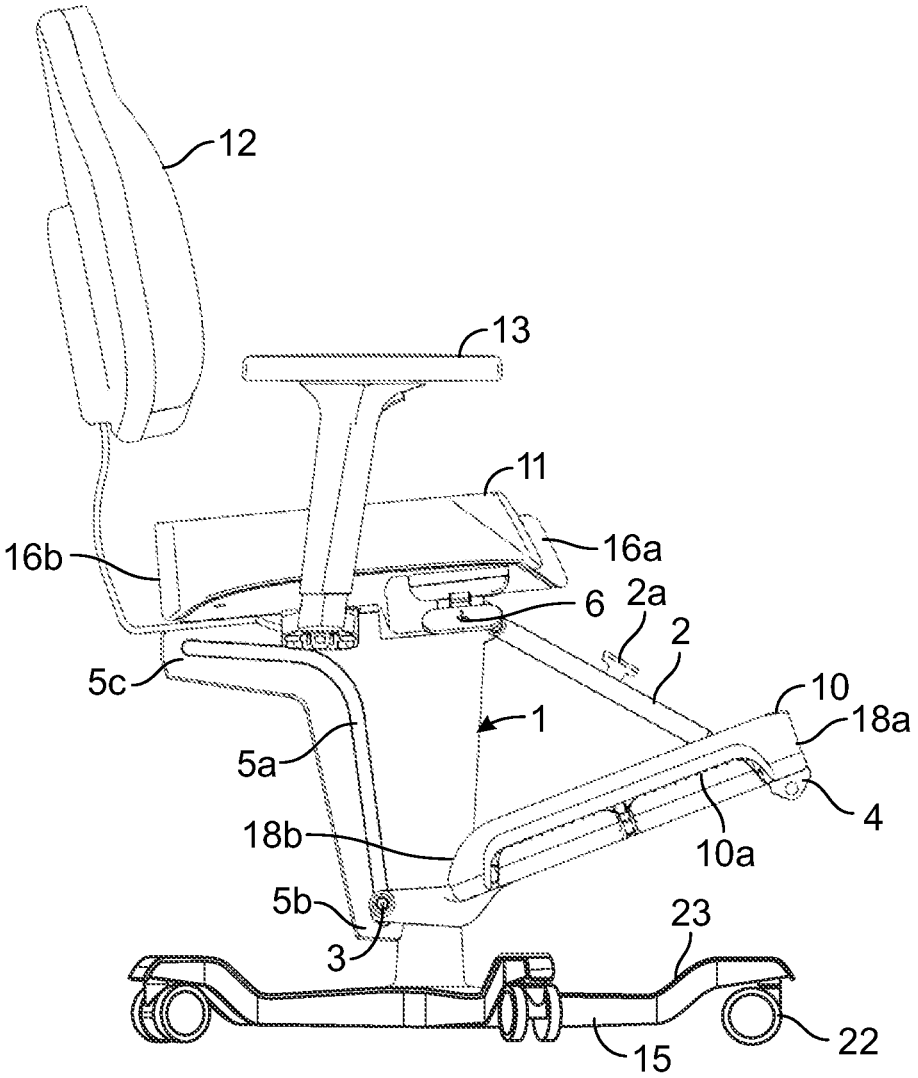

FIGS. 3A-3C show second stage Knee Deploy Transition operations; stages of Knee Deploy In transition operations; FIGS. 2A, 3A Deployment of Kneeling position chair assembly 17 raises under its front and rear portions 16*a*, 16*b* of ratchet mechanism 8, 9 tiltable seat cushion 11 to a second position where the knee pads are positioned in front of the tiltable seat cushion 11, with the rear portion 16*b* substantially tiltable seat cushion 11 elevated mechanism 8, 9 for tilt of seat assembly 17, with FIG. 3B showing continuation of kneeling deployment, as second knee pad follower 3 moves along Exo frame Track 5*a* raising kneepads 10 into position. FIG. 3C shows Kneepads 10 fully deployed second knee pad follower 3 all the way locked into 5*b* lowest position. In FIG. 3D the sitting and kneeling chair is in its Kneeling Position. In this position, the user is gently thrown forwards onto their knees. The brain sends a signal to the abdominal muscles to catch the body from falling. The abdominal muscles engage gently holding the body in a straight back posture. This Core Activation takes the pressure off the back muscles and shifts gently to the abdominal muscles creating a unique postural kneeling solution. FIG. 3E illustrates Knee Fit Lower Stop 5*b* in kneeling mode prior to seat bottom being tilted. Kneepads Deployed.

Figure 3F:
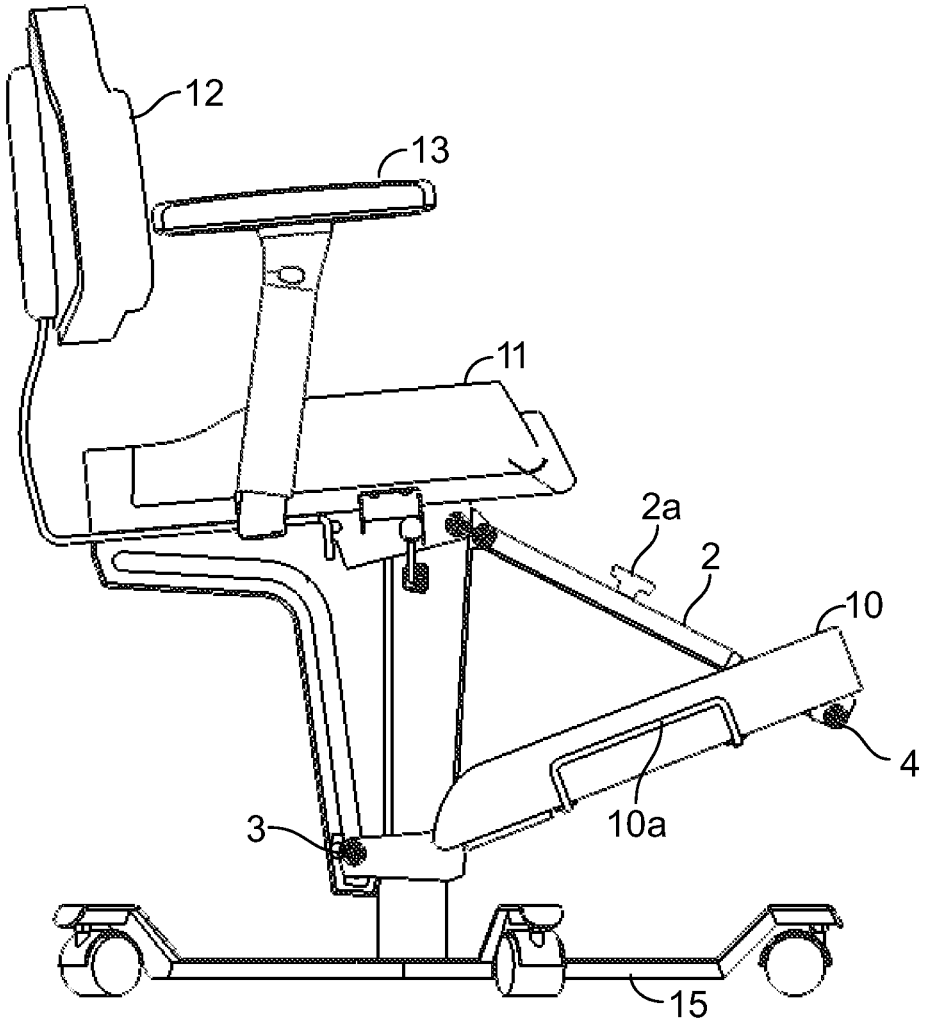
Figure 3G:
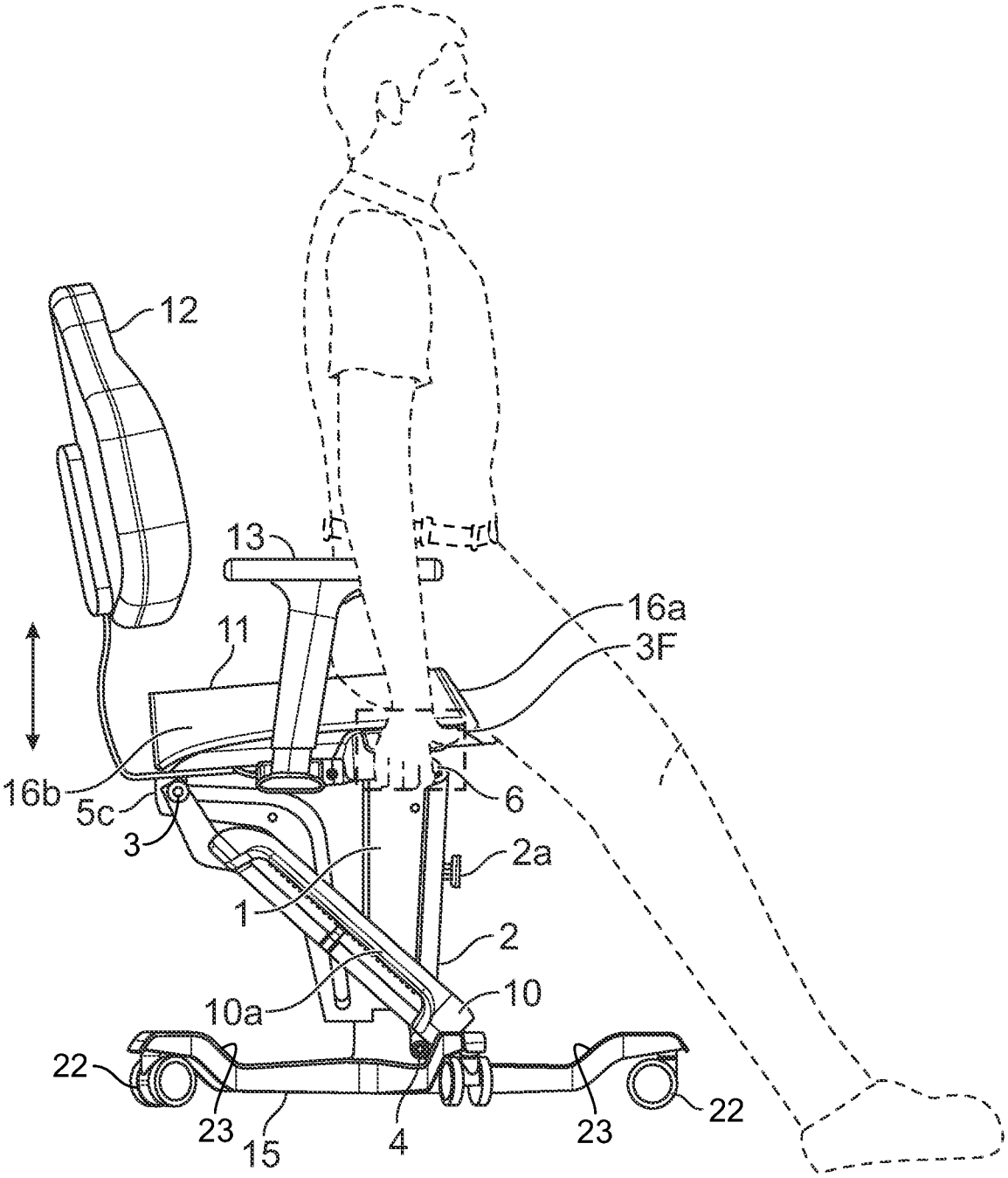

FIGS. 3F and 3G illustrate seat up and down functions, pulling the right handle 6 Seat Height Mechanism to adjust the seat height.

Figure 3H:
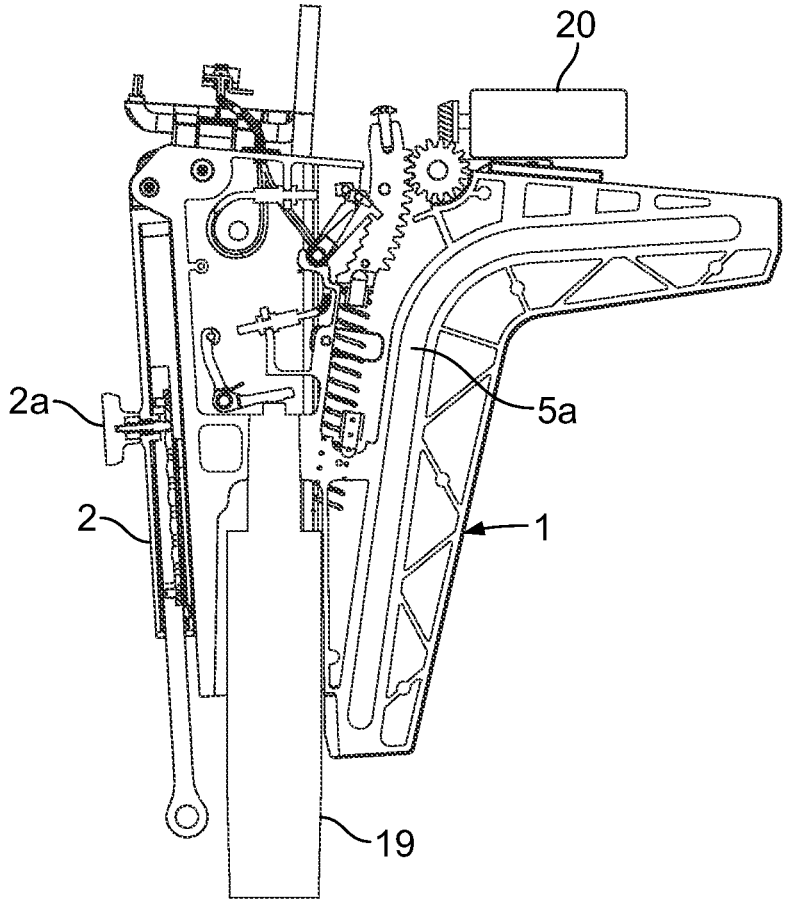

FIG. 3H illustrates automated mechanisms including motor, gear train sequencing intended user operations/motorized use with electronic motor 20 mounted in an alternate frame structure 1 below with seat assembly 17. When in use, motor 20 will deploy the knee pads into kneeling position. The motor 20 will also deploy the tilt function on the seat bottom and adjusts the length of the knee linkage 2 through corresponding drive equipment. The motor will allow user to set the angle where feel most comfortable. When ready to exit the chair, motor 20 will be used to reset the seat bottom and knee pads into the stored and locked position. A control device or circuitry operates the drive motor 20 and may include a display unit (not shown).

Figure 3I:
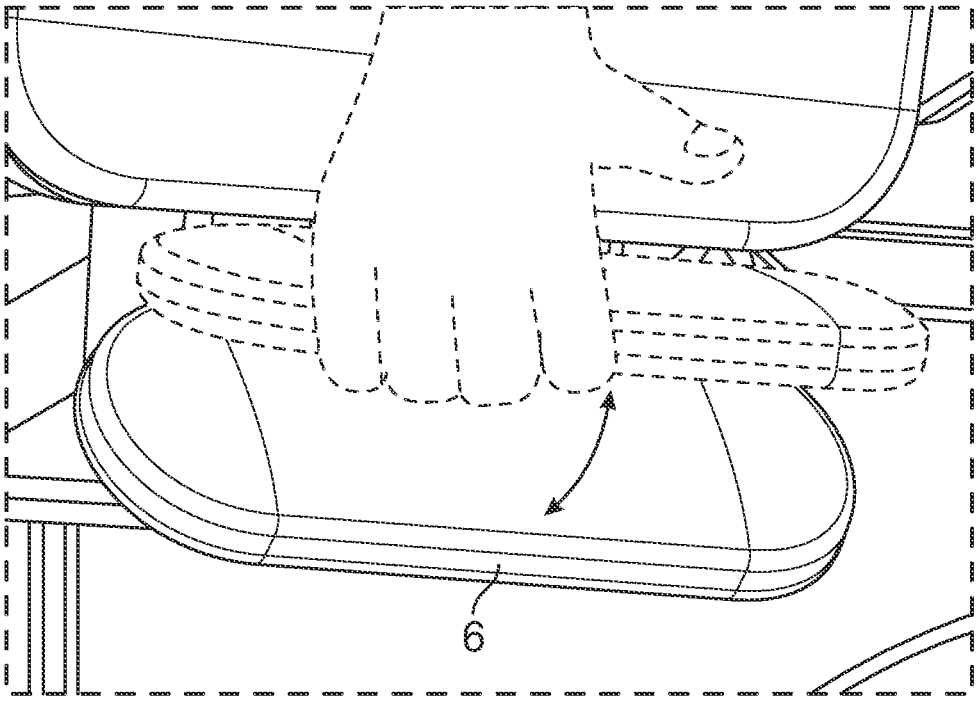
Figure 3J:
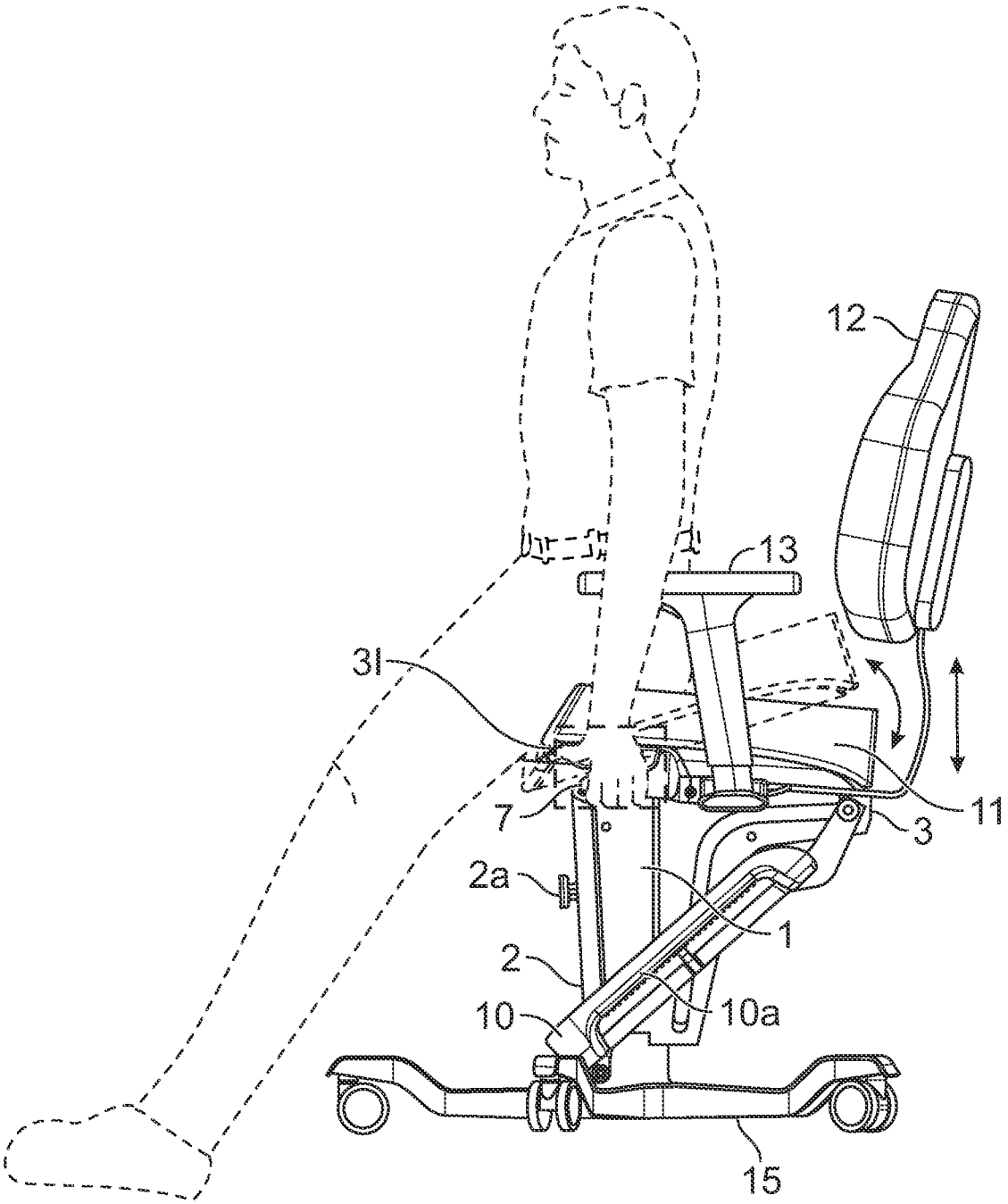

FIGS. 3I and 3J illustrate seat tilting angled up and down functions, pulling the left handle, allowing seat tilt from first position to the top, e.g., five (5) steps for the (1, 2-5) positions Tilt Control Handle 7 position, with ratchet or torsion spring release mechanisms such that no need to pull the handle 7, and can tilt up by the users' body while moving. With the tilt release lever 7 once lifted the seat bottom moves from a locked position. Once unlocked by this lever 7, the user can use their body weight to tilt the seat bottom forward as much as they are comfortable with. When seat bottom is tilted forward in concert with kneepads being deployed, the user is offered a unique kneeling option in a novel fashion. When done working, users' can move seat bottom into traditional position and store the kneepads.

Figure 3K:
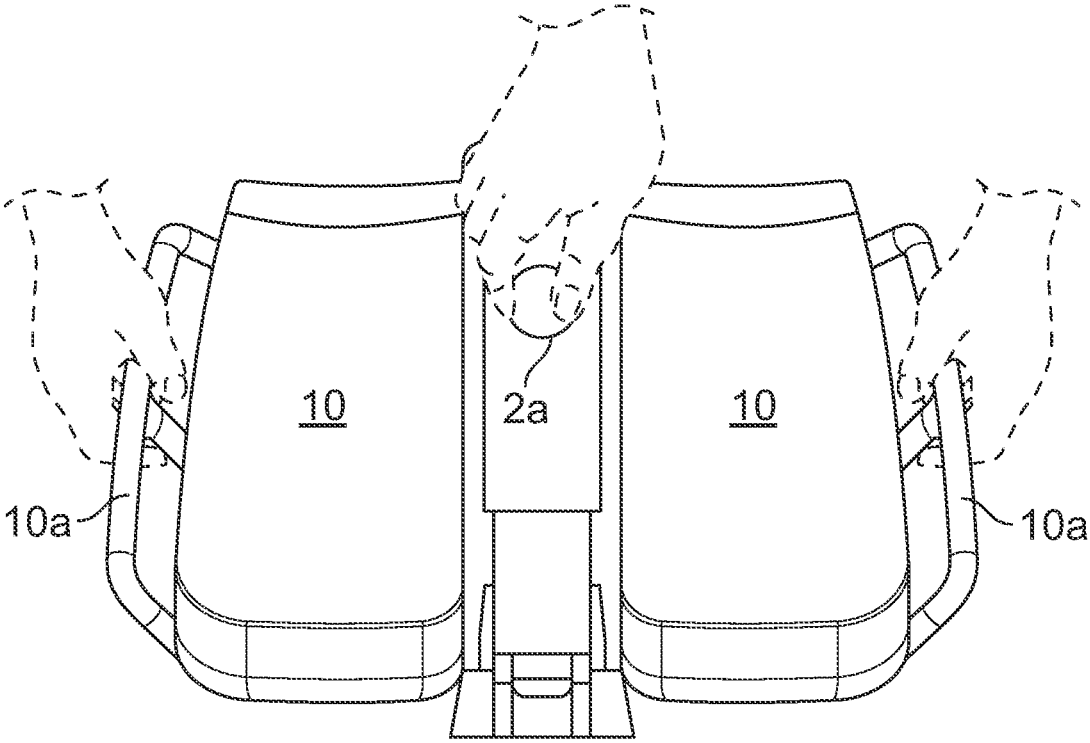
Figure 3L:
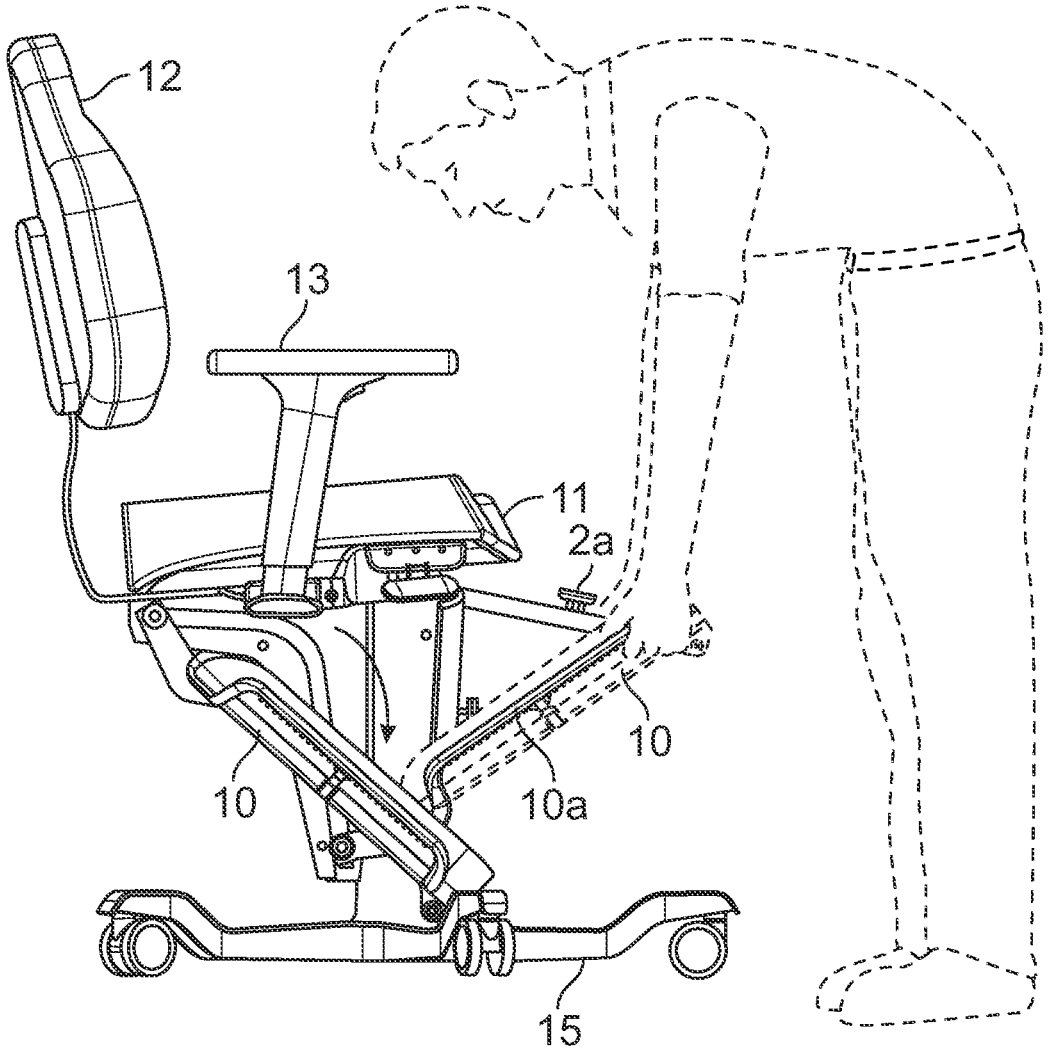
Figure 3M:
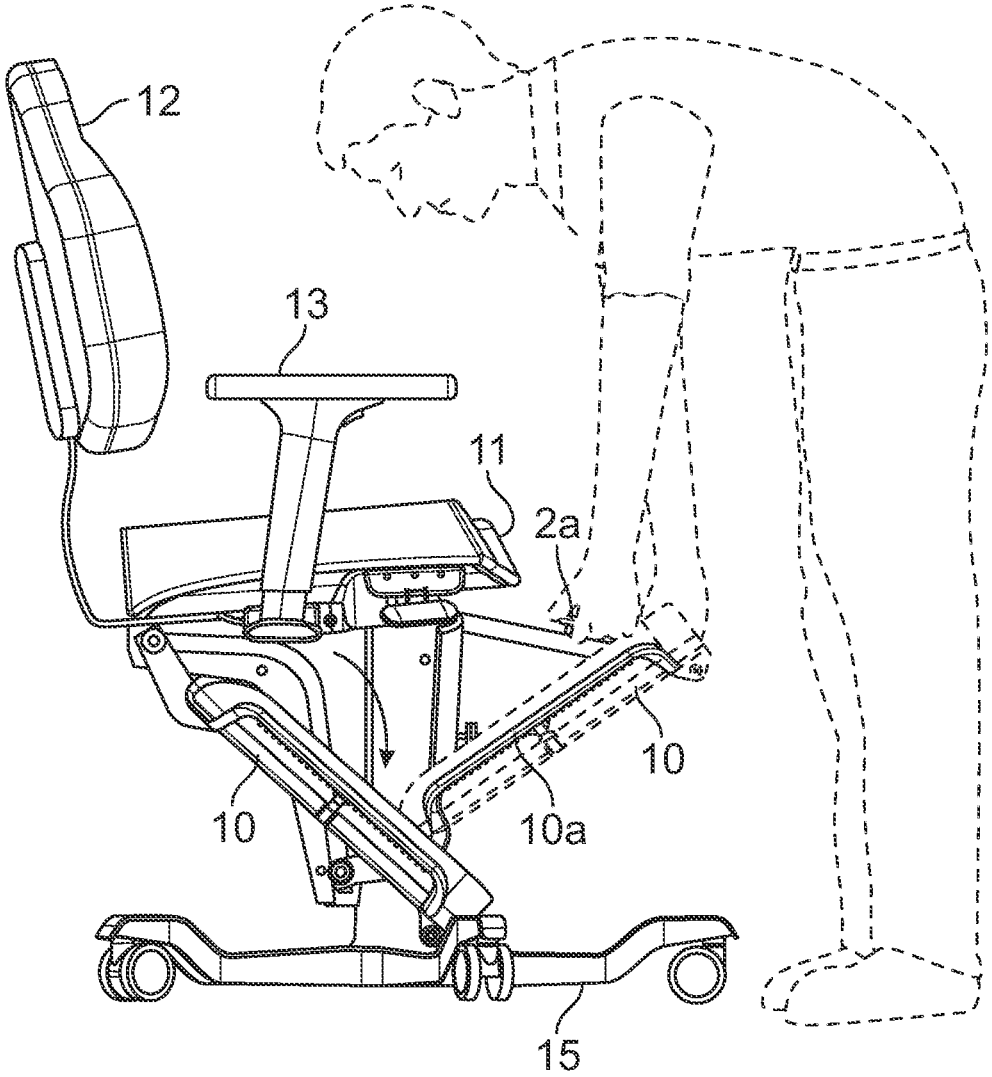

FIGS. 3K, 3L, 3M illustrate Knee pad movement where holding the handles 10*a* by two hands and move the Knee pad linkage 2 and adjustment 2*a* to up or bottom position through the rail of EXO frame 1, allowing Knee pad height adjustment by pulling handle knob up 2*a* and move the knee pad 10 up and down to adjust according to personal needs.

Figure 4A:
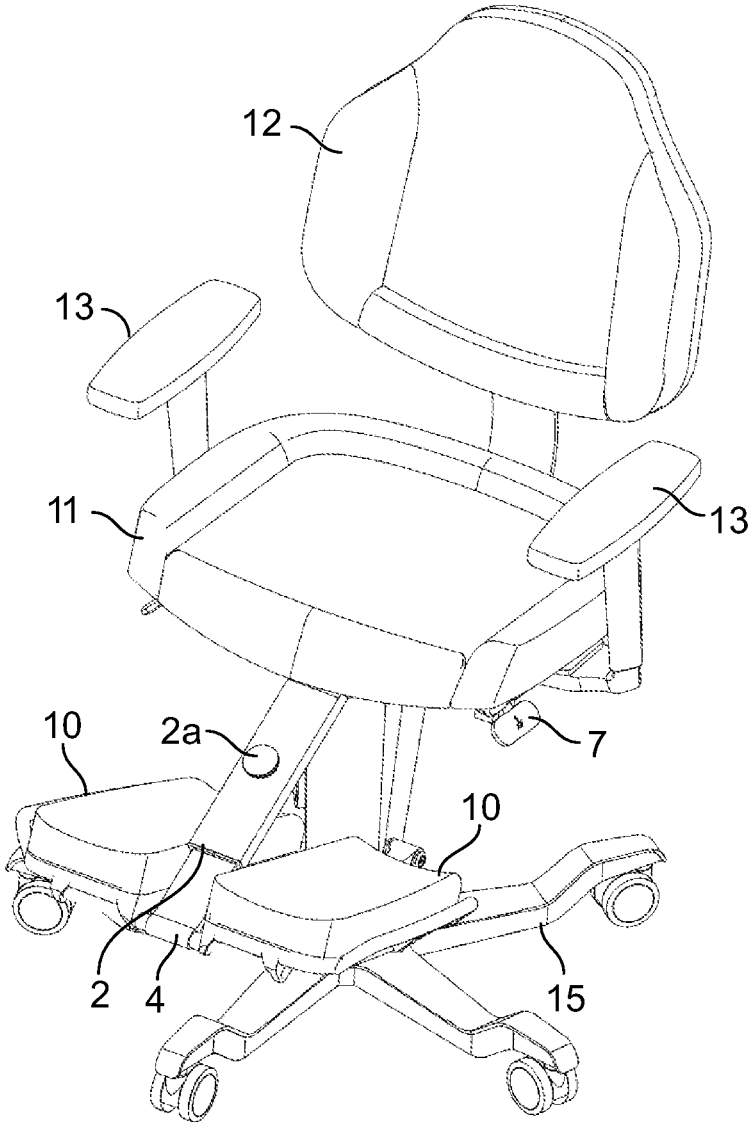
FIGS. 4A, 4B respectively show perspective views with chair with kneepads deployed, with FIG. 4B illustrates Knee Fit Upper Position.
Figure 4B:
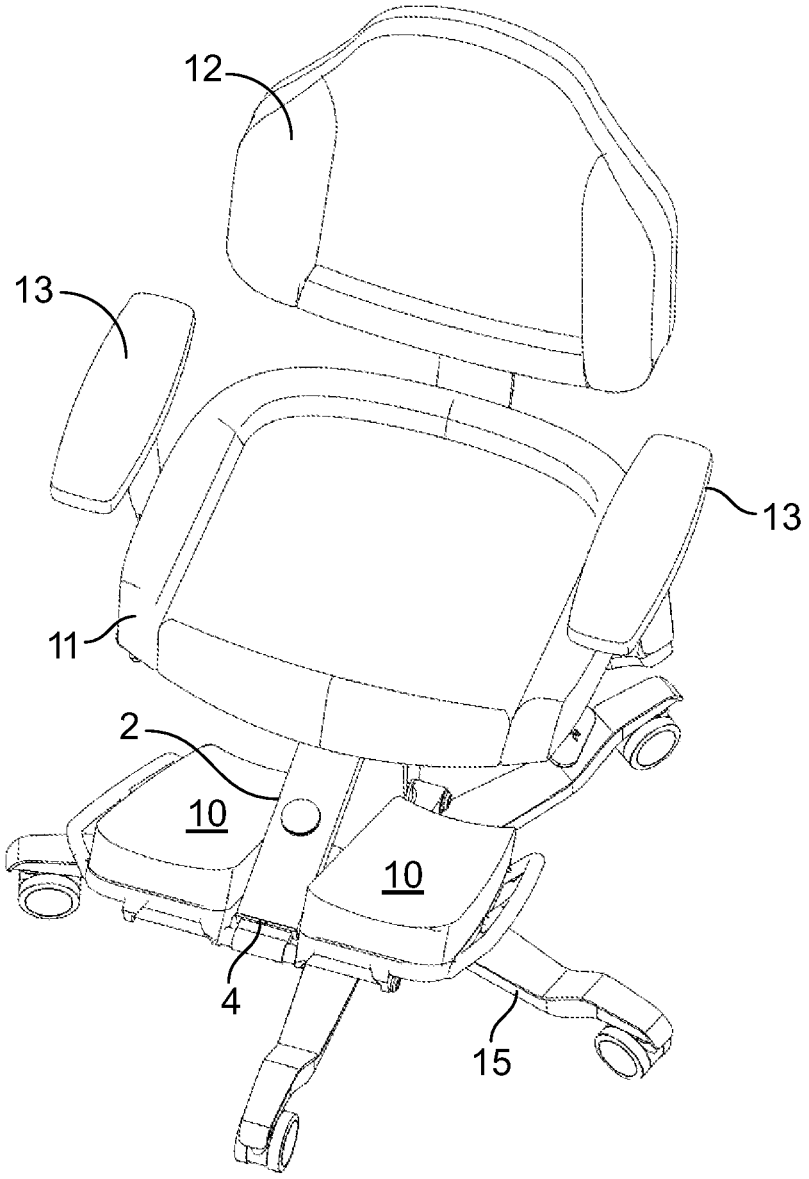
Figure 4C:
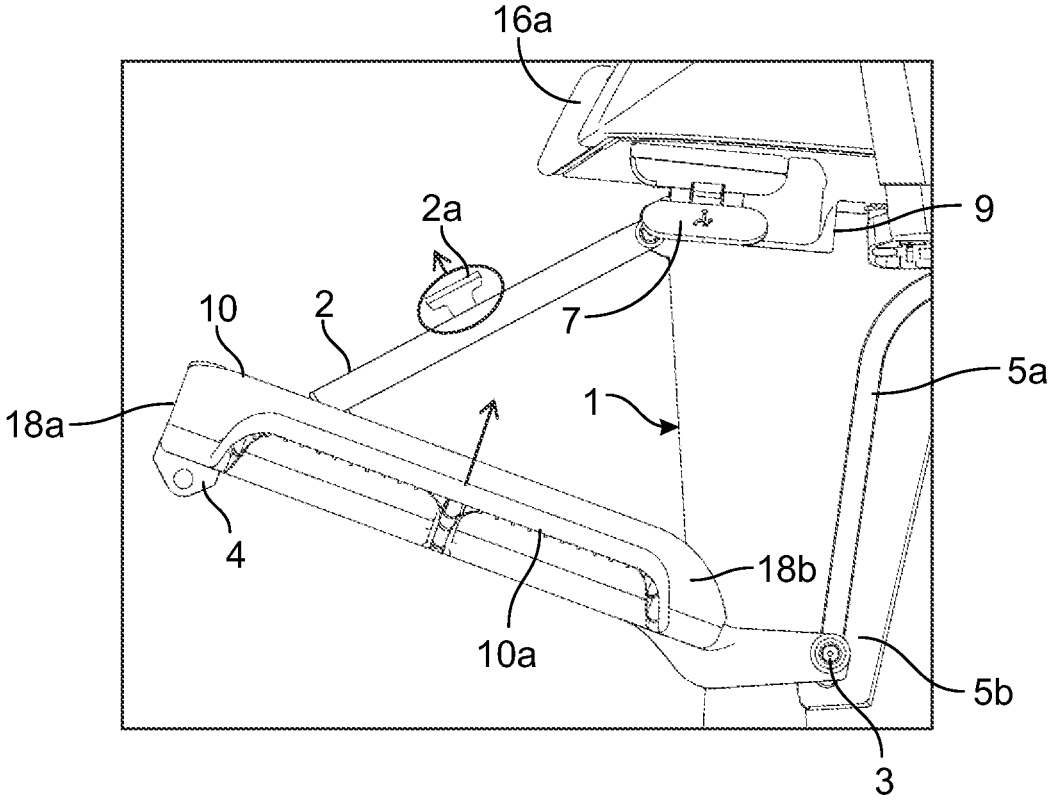
FIG. 4C shows Knee Fit Upper Position Touch Points.

FIG. 4A illustrates a perspective view of chair with kneepads deployed, and FIG. 4B illustrates Knee Fit Upper Position 2; Head-on view of chair with kneepads deployed and seat 11 tilted forward; FIG. 4C shows Knee Fit Upper Position Touch Points; Circle knob 2*a* represents the knee height adjustment-by pulling to disengage, the user can raise and lower the kneepads into their most comfortable position.

Figure 5D:
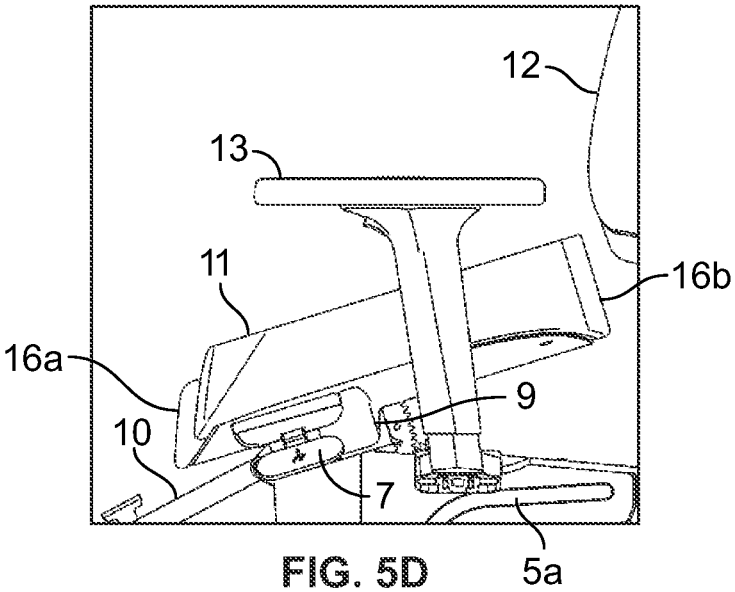
Figure 5E:
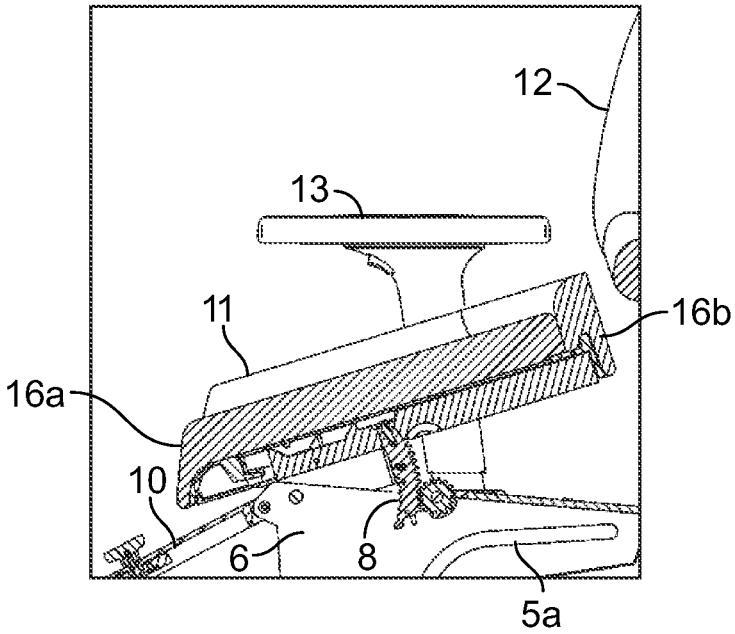
Figure 5F:
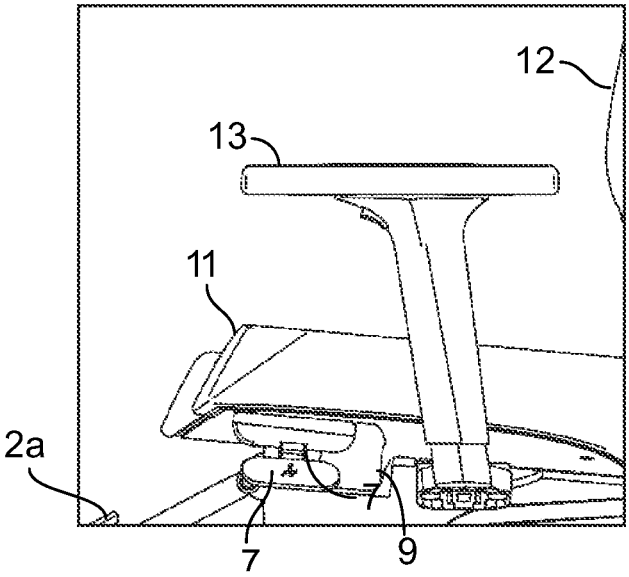
Figure 5G:
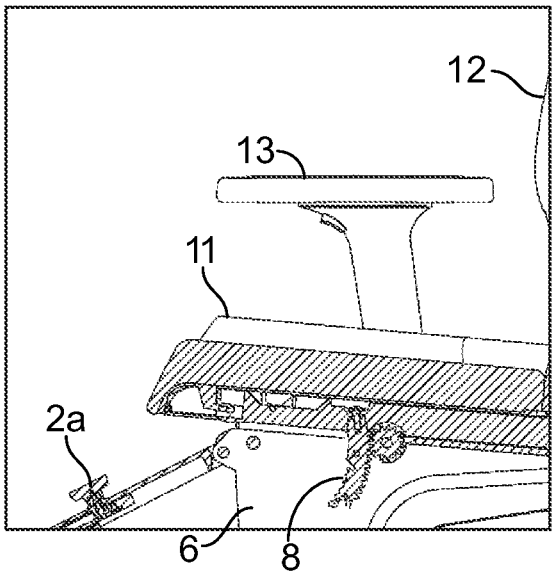

FIG. 5A is a Head On view of seat in traditional Sitting Position kneepads stored, seat bottom flat and locked. FIGS. 5B and 5C Show the seat prior to being put onto the ExoFrame (8) is the tilt mechanism allowing the chair bottom to raise and lower. FIGS. 5A, 5B and 5C facilitate Seat Height Touch Points, with operating element of FIGS. 5D and 5E adjusting Seat Tilted for Kneeling, where FIGS. 5F and 5G adjust positioning the Seat for Standard Seating. FIGS. 5D and 5E Seat Tilted for Kneeling/adjusting Seat Tilted for Kneeling deployed to unlock the seat from the flat position in 5E the gear is released and the user can lock into whatever position along the track they find most comfortable. Seat Tilt Mechanism controls the tilt position of the seat. Tilt Control Handle 7 lifts to unlock the seat to return from Kneeling Position. tiltable seat cushion 11 elevated mechanism 8, 9 for tilt of seat assembly 17 torsion spring latch Ledge Locking Surface with elevated mechanism 8, 9. FIGS. 5A, 5B and 5C facilitate Seat Height Touch Points; Back height adjustment: hold the back by hand at each side and move up the back, if move down, need to move up to the highest then can go down. FIGS. 5F and 5G adjust positioning of the Seat for Standard Seating.

Figure 5H:
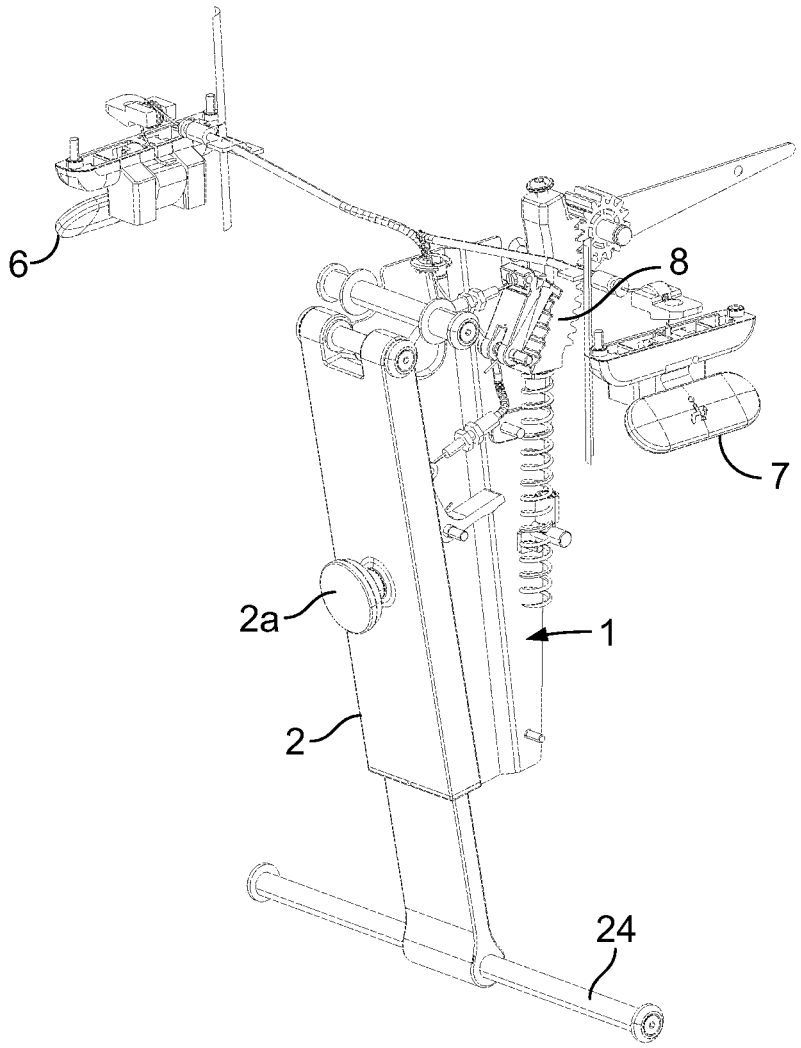
Figure 6A:
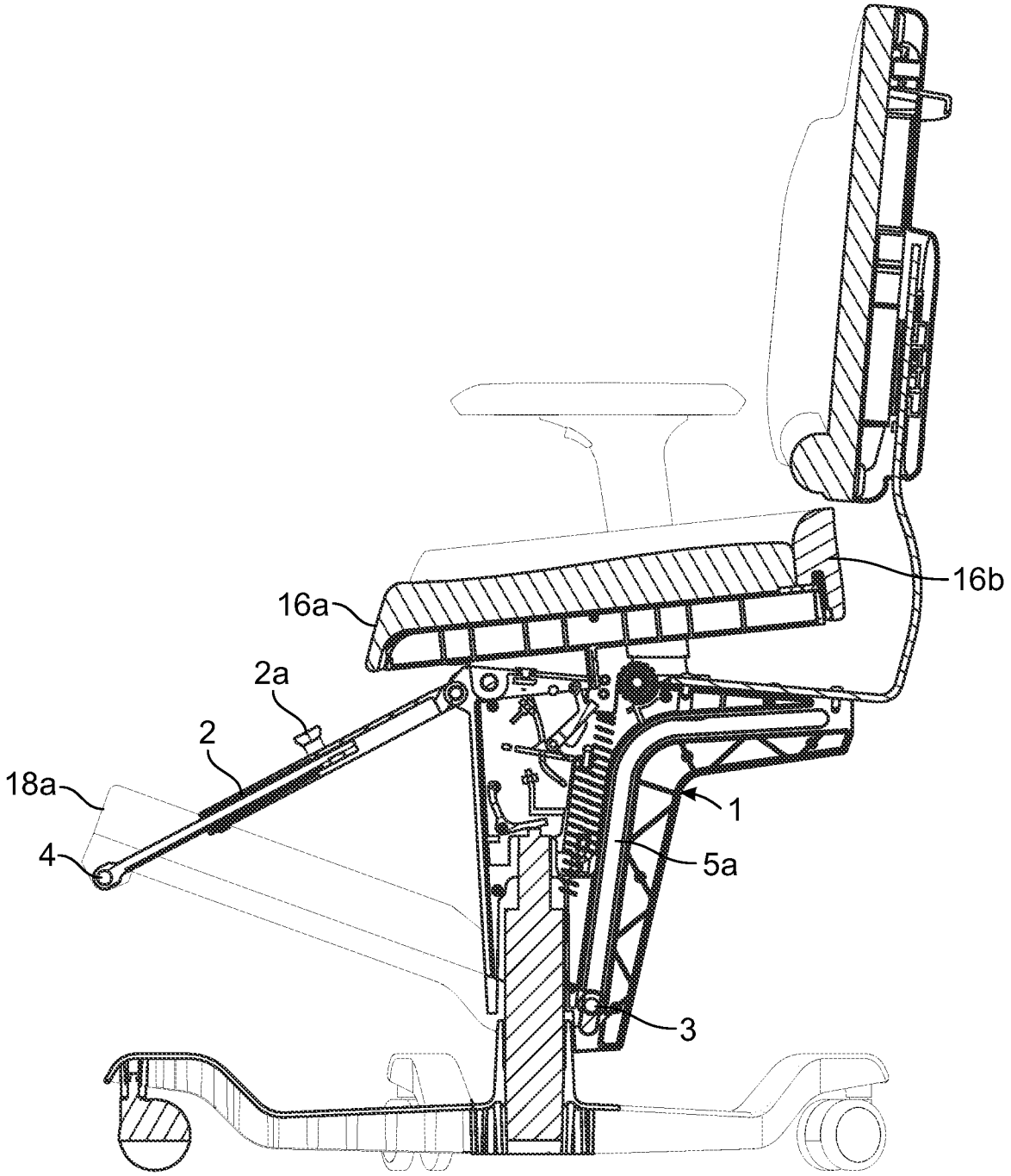
FIGS. 6A-6C illustrate Seat Tilt motion, with FIG. 6B illustrating a sideview of full Kneeling Mode with kneepads deployed and seat bottom tilted forward.

FIG. 5H shows the internal mechanisms to the Frame track system created to move the user from a traditional seated position to kneeling. FIG. 6A is a partial side elevational sectional view of chair with frame 1 in kneeling mode partial seat bottom tilt, further showing the internal mechanisms to the Frame track system created to move the user from a traditional seated position to kneeling.

Figure 6B:
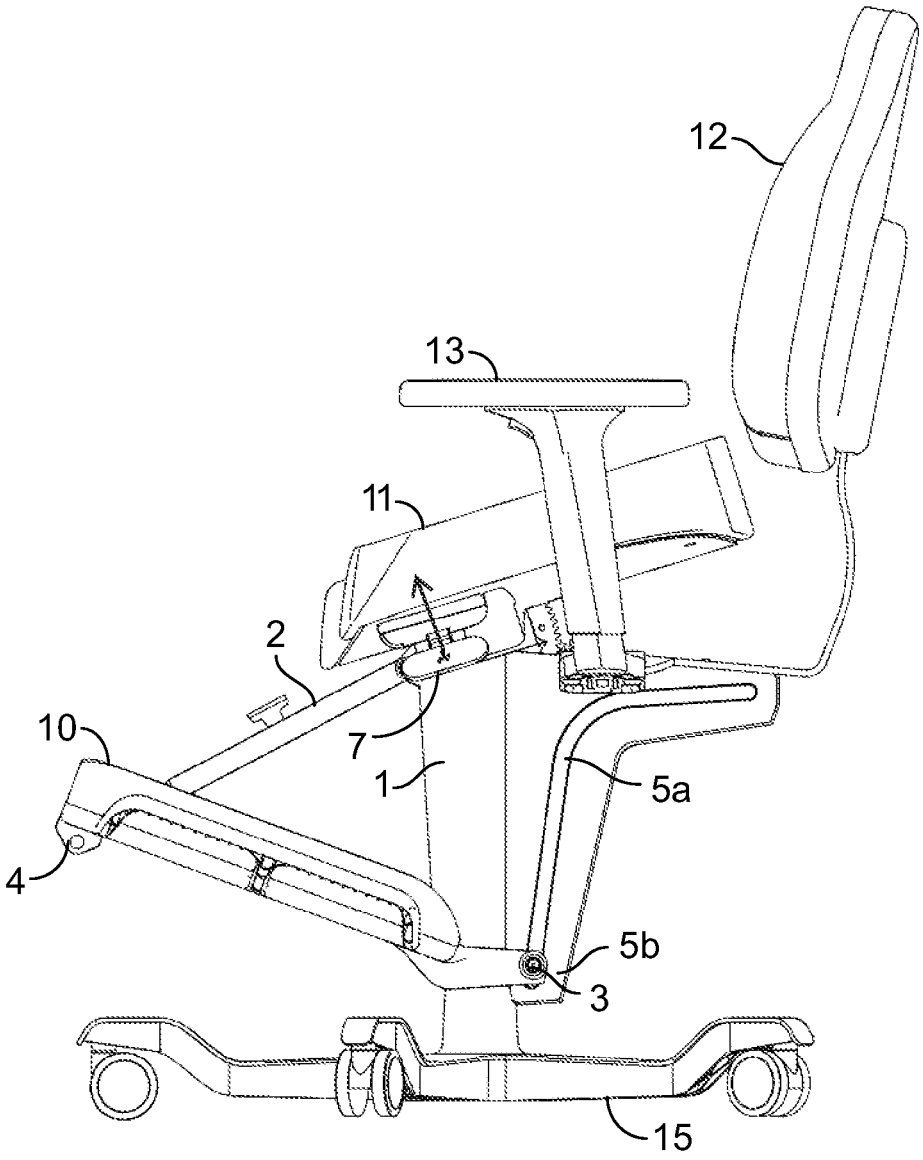
Figure 6C:
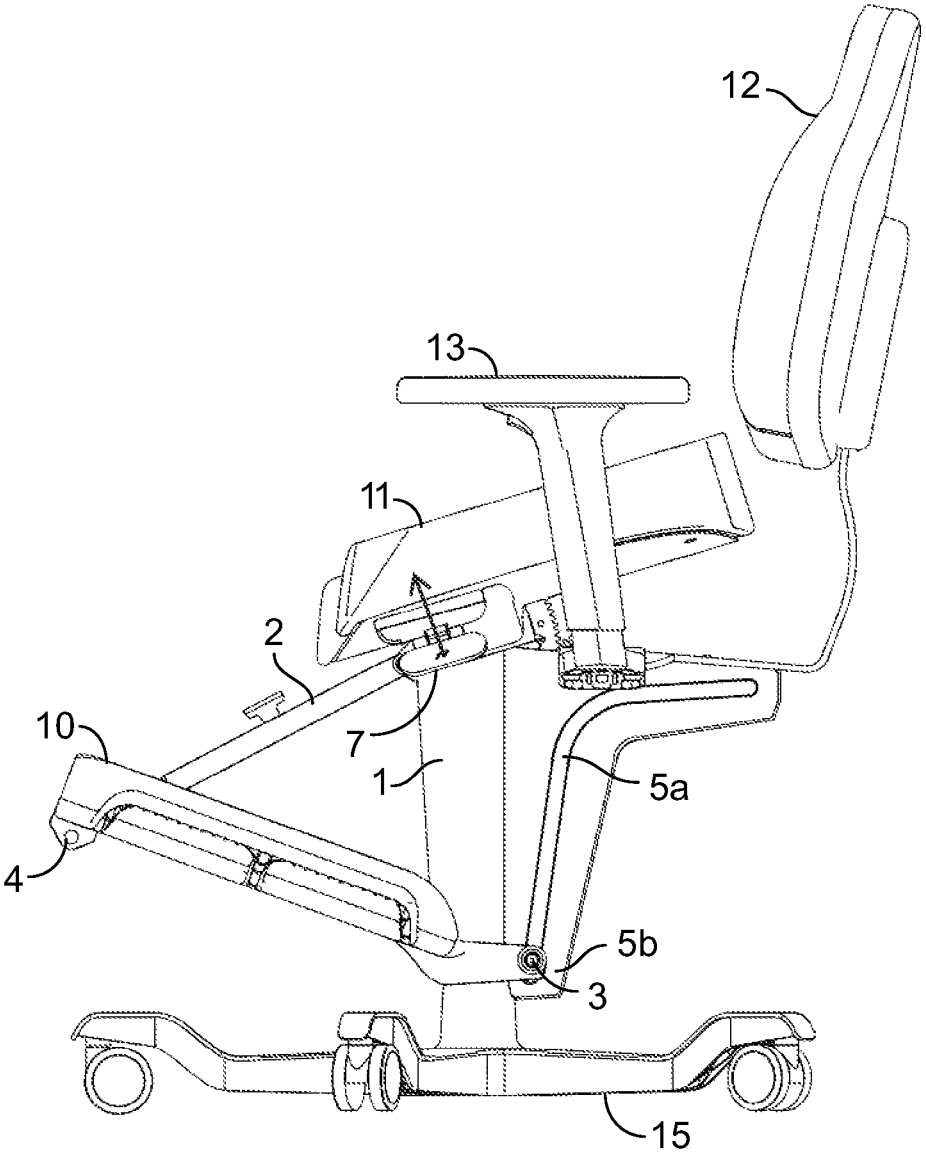

FIGS. 6A-C illustrate Seat Tilt motion, with FIG. 6B illustrating a sideview of full Kneeling Mode with kneepads deployed and seat bottom tilted forward; FIG. 6C has lever handle 7 released to allow tilting function, and FIG. 6D initiates Seat Tilt Return. Returning to a seated position involves leaning slightly forward, with handle 7 released to return seat bottom to locked position while kneepads are still deployed; to remove weight from the seat ratchet, activating the lever below the left side of the seat, and sitting back into the standard seat position. To return the seat to the seated position the user shifts their weight.

Figure 6D:
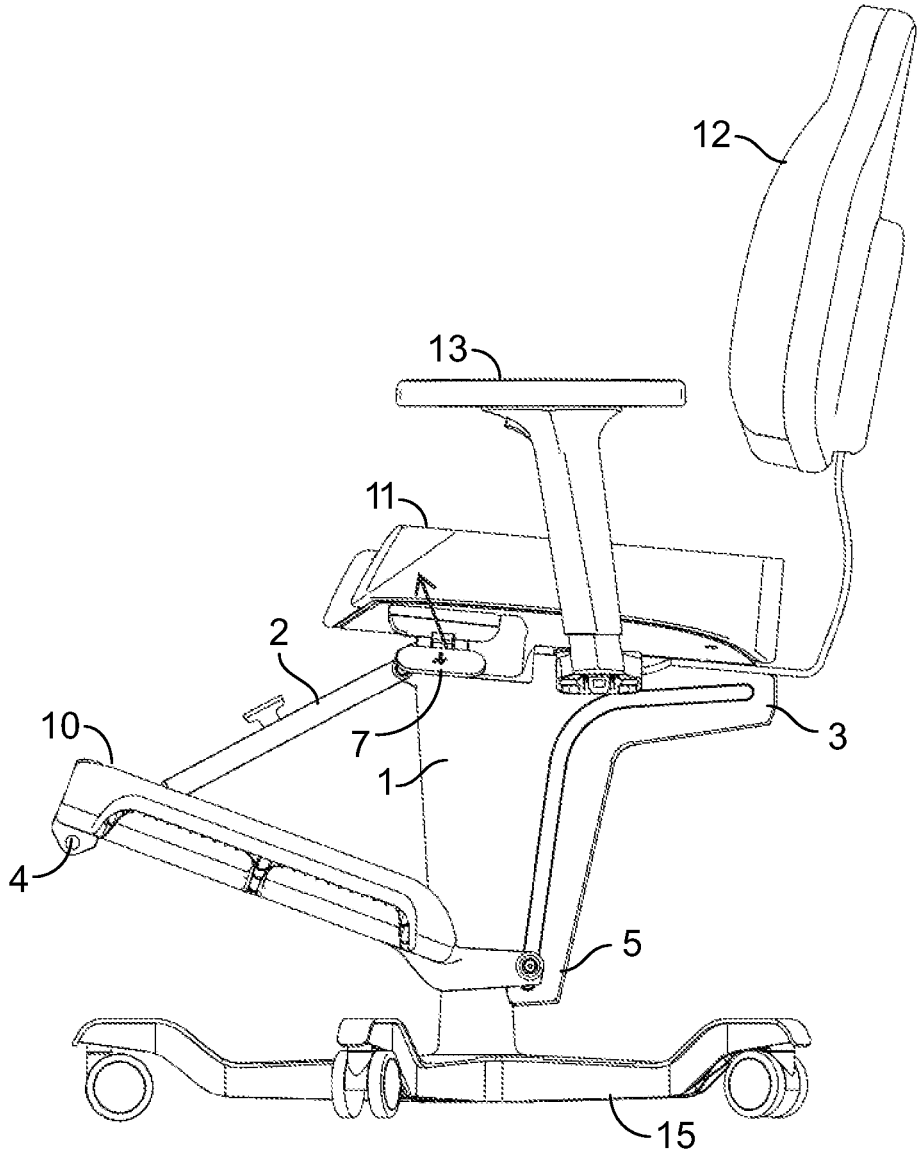

FIG. 6A shows the Seat Tilt Motion, illustrating FIG. 6B and FIG. 6C Seat Tilt Positions. The seat can tilt forward 20 degrees from the seated position promoting "core engagement". This is done by the user shifting their weight forward, engaging their core. The Seat Tilt Mechanism 6 is sprung with elevated mechanism 8, 9 for tilt of seat assembly 17 torsion spring latch and will catch on the latch in multiple positions, e.g., first at approximately 10 degrees of movement and the second at 20 degrees. FIG. 6D initiates Seat Tilt Return. Returning to a seated position involves leaning slightly forward to remove weight from the seat ratchet, activating the lever below the left side of the seat, and sitting back into the standard seat position. To return the seat to the seated position the user shifts their weight forward and lifts the Tilt Control Handle 7; this rotates the Seat Tilt Mechanism in conjunction with the kneeling pads when the kneeling pads are deployed. It locks the seat cushion in a position that tilts forward, toward the front of the occupant, toward the desk, table, or work surface. The combination of the seat angle with the knee pad positions creates individualized settings to fit each users' preferences allowing a wide range of ergonomic positions. In the included drawings the tilting mechanism locks in five (5) positions, through Horizontal, low tilt, high tilt. Other embodiments should also include infinite adjustment of tilt, or any number of discrete locking points.

Figure 7A:
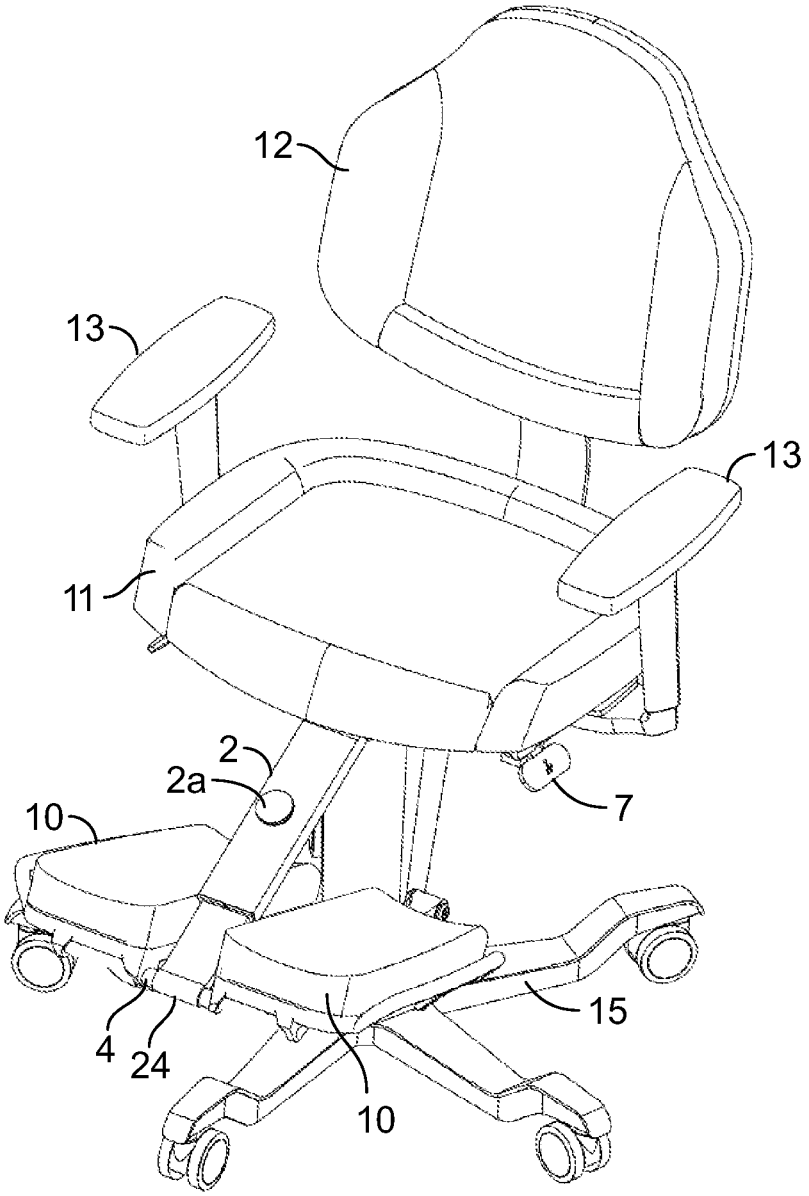
FIGS. 7A and 7B are perspective views respectively showing Knee Pads Deployed kneeling mode prior to seat bottom tilted in FIG. 7A, with FIG. 7B having Knee Pads Stowed with Chair in full traditional mode all parts stored.
Figure 7B:
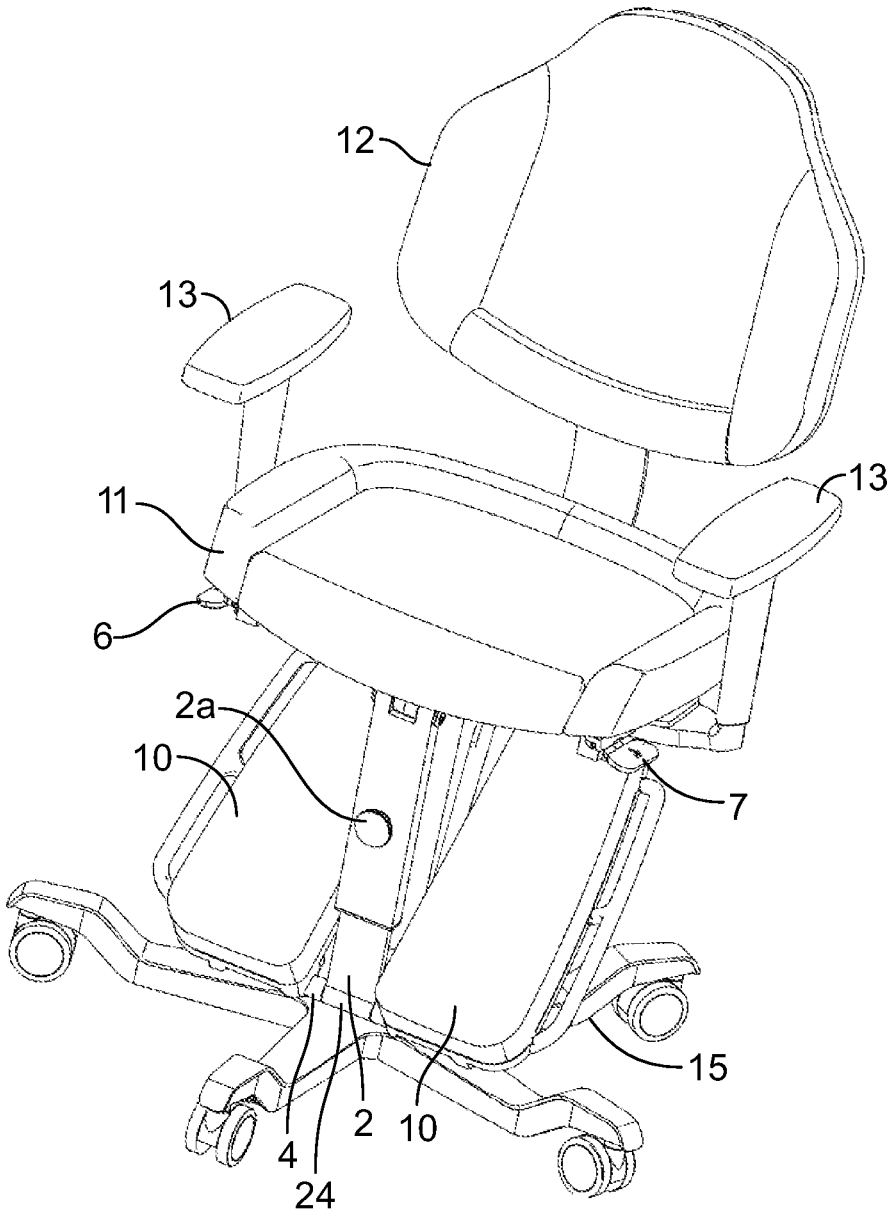
Figure 8:
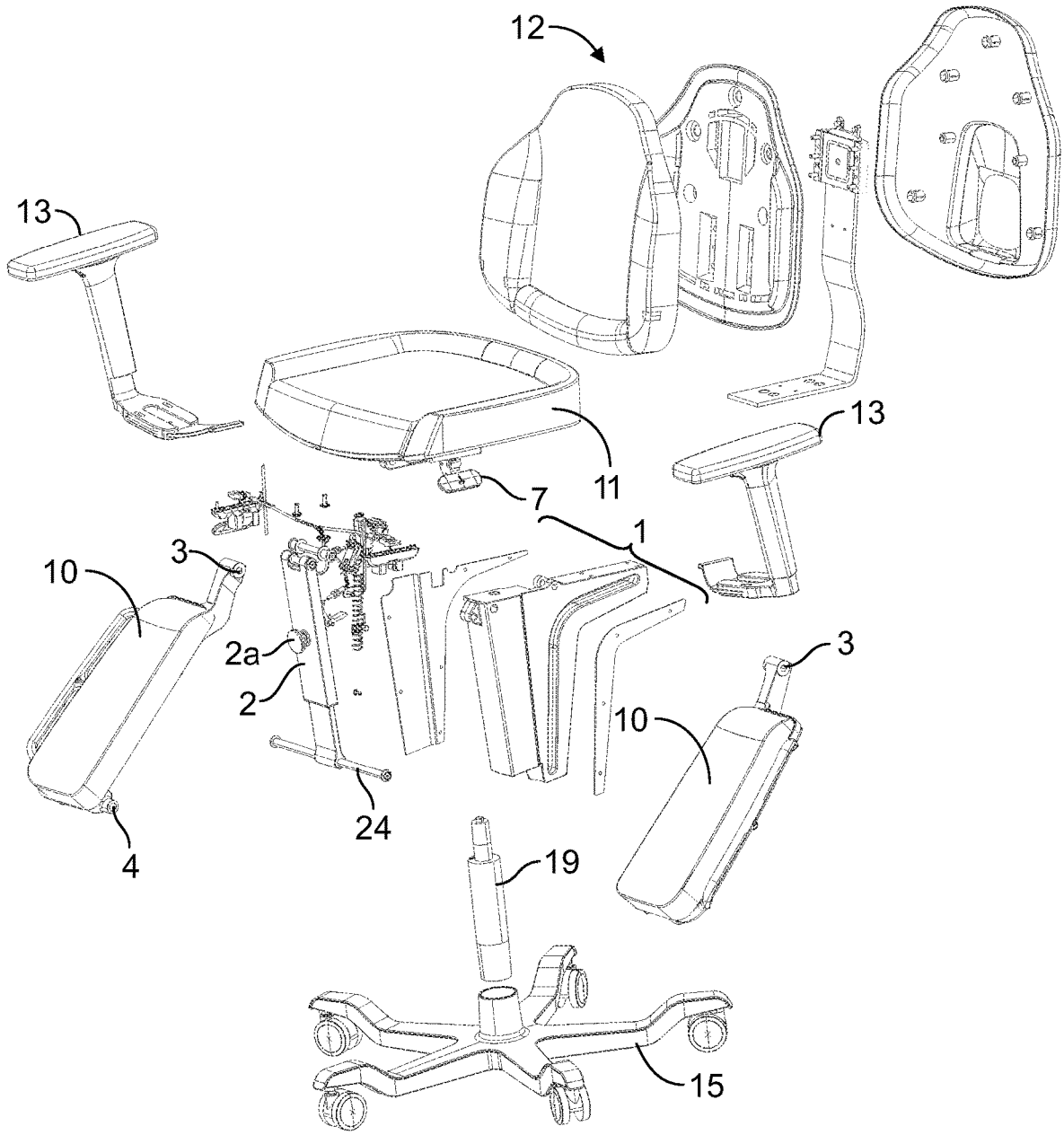
FIG. 8 shows an exploded view of the parts of the adjustable portable sitting and kneeling chair system.

The chair therefore is unique in that it is used in a very common way as a standard office chair, or medical professional chair, gaming chair, and similar applications however it can deploy the kneeling pads and tilting cushion and effectively convert to be used in a kneeling position for a unique and varied seating experience. The user then returns their weight back to the seat and it returns to a seated position. FIG. 7A shows the Knee Pads Deployed. FIG. 7B shows the Knee Pads Stowed, with FIG. 8 illustrating Exploded View (Knee Pads Stowed).

The Knee Pads 10 are adjustable via 2 independent adjustment points. The Knee Link 2 has a pull knob that allows a user to adjust the distance between the novel Exo-Frame 1 and the front of the Knee Pad Pivot 4. The user may also adjust the Lower Knee Stop 5*b* advantageously by lifting the fastener, sliding it up or down the track in the Exo-Frame 1 and re-tightening at the desired position. This changes the distance between the Seat 11 and the back of the Knee Pads 10. Both of these adjustments are persistent in that the user can stow the Knee Pads 10 and upon further deployments return to the same positions in such a way that it can be stowed under the seat cushion and above the rolling base when not in use, and easily deployed while the occupant/user is seating in the chair allowing for quick and easy transition from standard seating, to a kneeling position. This allows for a significant change of posture, muscles usage, and interaction with the desk, tools, games, computers, patients, etc. like what a height adjustable desk or tables do for workers adjusting their working position while allowing the work to continue, adding to variation in positions which is thought to be beneficial to health and avoiding injury. The user can lengthen or shorten the knee linkage assembly with handles to the outside of the kneepads to give the user an obvious touch point for deploying/stowing the kneepads.

The sitting and kneeling chair systems described above provide users with a workspace option in which a stored sitting and kneeling chair system may be easily opened as a fully assembled product and adjusted to fit their body. Transition between the various positions and configurations does not require additional parts or tools. The sitting and kneeling chair variable height ranges up to 30-degree tilt allow the user to customize their workspace according to work needs and style and without obstructing workspace of the sitting and kneeling chair top. Additionally, the seat and knee support height and angle may positively influence the user's posture while working at the sitting and kneeling chair and may be adjusted to accommodate various user body types and sizes. The combination of the seat angle with the knee pad positions creates individualized settings to fit each users' preferences allowing a wide range of ergonomic positions.

FIGS. 7A and 7B are perspective views respectively showing Knee Pads Deployed kneeling mode prior to seat bottom tilted in FIG. 7A, with FIG. 7B having Knee Pads Stowed with Chair in full traditional mode all parts stored.

FIG. 8 shows an exploded view of the parts of the adjustable portable sitting and kneeling chair system. Knee Pad Followers 3, and Lower Knee Stop 5*b* facilitate sliding motions lifting, and fastening, within the track of the Exo Frame 1. FIGS. 2B-2D and FIGS. 3B-3D show kneeling chair Knee Pad deployment using the track of the Exo-Frame 1. FIGS. 1, 2B. FIG. 3A-3C stages of Knee Deploy Transition operations secure positioning with FIG. 3E. FIGS. 4A and 4B shows the Knee Fit Upper adjustment positions, and FIG. 4C shows Knee Fit Upper Position Touch Points. Knee linkage 2 controls motion of the front of the knee pad. Knee Pad Follower 3 controls motion of the back of the knee pad. Knee Pad Pivot 4 provides connection point of the front of the Knee Pads 10 to the Knee-Link 2, 2*a*. Lower Knee Stop 5*b* sets the deployed position of the Knee Pad. Seat Tilt elevated mechanism 8, 9 for tilt of seat assembly 17 latch controls the tilt position of the seat.

Several unique functions empower users to transition from a seated to kneeling position a user moves knee pads 10 forward via handles along the outside of each. The motion of the knee pads 10 are controlled by the travel of the Knee Pad Follower 3 along the profile in the Exo Frame 1 and the Knee Linkage 2 attached via the Knee Pad Pivot 4, 24 to the front 18*a* of the Knee Pads 10. The Transition from kneeling to seated is accomplished by the user gripping and lifting the Knee Pads 10 or via handles 10*a* on either side of the outside of each, raising the Knee Pad Follower 3 along the profile in the Exo Frame 1 kneeling functions based on the Exo Frame, in both transitions no buttons/levers/switches are used.

From the foregoing, it can be seen that there has been provided features for eSports sitting and kneeling chair methods and systems. While a particular embodiment of the present invention has been shown and described, it may become apparent to those skilled in the art that changes and modifications may be made without departing from the invention in its broader aspects. Therefore, the aim is to cover all such changes and modifications as fall within the true spirit and scope of the inventions. The matter set forth in the foregoing description and accompanying drawings is offered by way of illustration only and not as a limitation, thus it is intended that the foregoing detailed description be regarded as illustrative rather than limiting.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to marketability, appearance, consistency, robustness, customer acceptability, reliability, accuracy, etc. As such, embodiments described as less desirable than other embodiments or prior art implementations with respect to one or more characteristics are not outside the scope of the disclosure and can be desirable for particular applications.

The invention claimed is:

1. A sitting and kneeling apparatus, comprising:

a seat cushion having a front portion and a rear portion;

a seat assembly connected under the seat cushion;

a frame support structure having an upper portion located below said seat assembly;

an adjustable height element at said frame support structure;

a base receiving the adjustable height element, said base supporting the adjustable height element above a substantially horizontal floor surface for raising and lowering said frame support structure with said seat cushion and seat assembly, said frame support structure having a lower portion located above said base;

a first knee pad having a front portion and a rear portion for a deployed orientation where the front portion is above the rear portion with the front portion extending outwardly from the frame support structure, and an inverted orientation where the front portion is below the rear portion for storage with the front portion near the base and the rear portion alongside the frame support structure and below said seat assembly;

a second knee pad having a front portion and a rear portion;

a knee linkage;

a frame support pathway at said frame support structure;

a first inverting knee assembly connected under the first knee pad, said first inverting knee assembly having a front end and a rear end, said first inverting knee pad assembly having a first knee pad pivot at the front end of said first inverting knee assembly and a first knee pad follower at the rear end of said first inverting knee assembly, said knee linkage coupling the first knee pad pivot with the upper portion of said frame support structure below said seat assembly, with the first knee pad follower at the frame support pathway for travel between the upper portion of said frame support structure and the lower portion of said frame support structure above said base;

a second inverting knee assembly connected under the second knee pad; and a first knee pad grip at the first inverting knee assembly for alternately positioning the first knee pad between the deployed orientation and the inverted orientation with the first knee pad follower traveling the frame support pathway between the upper portion of said frame support structure and the lower portion of said frame support structure.

2. The sitting and kneeling apparatus of claim 1, comprising a substantially vertical back cushion positioned above and behind said substantially horizontal seat cushion.

3. The sitting and kneeling apparatus of claim 1, wherein said second inverting knee assembly includes a front end and a rear end, said second inverting knee pad assembly having a second knee pad pivot at the front end of said second inverting knee assembly and a second knee pad follower at the rear end of said second inverting knee assembly, said knee linkage coupling the second knee pad pivot with the upper portion of said frame support structure below said seat assembly, with the second knee pad follower at the frame support pathway for travel between the upper portion of said frame support structure and the lower portion of said frame support structure above said base.

4. The sitting and kneeling apparatus of claim 1, wherein the first knee pad follower alternately travels toward the upper portion of said frame support structure with the first knee pad follower above the first knee pad pivot, and where the first knee pad follower alternately travels toward the lower portion of said frame support structure with the first knee pad follower below the first knee pad pivot.

5. The sitting and kneeling apparatus of claim 1, wherein said frame support structure comprises a motor for alternately driving the first knee pad follower toward the upper portion of said frame support structure with the first knee pad follower above the first knee pad pivot, and where the first knee pad follower alternately travels toward the lower portion of said frame support structure with the first knee pad follower below the first knee pad pivot.

6. The sitting and kneeling apparatus of claim 5, comprising a substantially vertical back cushion positioned above and behind said substantially horizontal seat cushion.

7. The sitting and kneeling apparatus of claim 1, comprising a pair of substantially horizontal arm rests above said tiltable substantially horizontal seat cushion and extending outwardly with respect to said substantially vertical back cushion.

8. The sitting and kneeling apparatus of claim 1, comprising a pair of arm rests on opposite sides of said substantially horizontal seat cushion.

9. The sitting and kneeling apparatus of claim 1, wherein tilting said seat cushion and simultaneously moving a knee rest stored under said seat cushion to a position in front of said seat cushion for supporting the human being in a partial kneeling position.

10. A sitting and kneeling apparatus, comprising:

a seat cushion having a front portion and a rear portion;

a seat assembly connected under the seat cushion;

a frame support structure having an upper portion located below said seat assembly;

an adjustable height element at said frame support structure;

a base receiving the adjustable height element, said base supporting the adjustable height element above a substantially horizontal floor surface for raising and lowering said frame support structure with said seat cushion and seat assembly, said frame support structure having a lower portion located above said base;

a first knee pad having a front portion and a rear portion for a deployed orientation where the front portion is above the rear portion with the front portion extending outwardly from the frame support structure, and an inverted orientation where the front portion is below the rear portion for storage with the front portion near the base and the rear portion alongside the frame support structure and below said seat assembly;

a second knee pad having a front portion and a rear portion;

a knee linkage;

a frame support pathway at said frame support structure;

a first inverting knee assembly connected under the first knee pad, said first inverting knee assembly having a front end and a rear end, said first inverting knee pad assembly having a first knee pad pivot at the front end of said first inverting knee assembly and a first knee pad follower at the rear end of said first inverting knee assembly, said knee linkage coupling the first knee pad pivot with the upper portion of said frame support structure below said seat assembly;

a second inverting knee assembly connected under the second knee pad, said second inverting knee assembly having a front end and a rear end, said second inverting knee pad assembly having a second knee pad pivot at the front end of said second inverting knee assembly and a second knee pad follower at the rear end of said second inverting knee assembly, said knee linkage coupling the second knee pad pivot with the upper portion of said frame support structure below said seat assembly; and a first knee pad grip at the first inverting knee assembly for alternately positioning the first knee pad between the deployed orientation and the inverted orientation with the first knee pad follower traveling the frame support pathway between the upper portion of said frame support structure and the lower portion of said frame support structure.

11. The sitting and kneeling apparatus of claim 10, wherein the first knee pad follower at the frame support pathway travels between the upper portion of said frame support structure and the lower portion of said frame support structure above said base, and wherein the second knee pad follower at the frame support pathway travels between the upper portion of said frame support structure and the lower portion of said frame support structure above said base.

12. The sitting and kneeling apparatus of claim 10, wherein the first knee pad follower alternately travels toward the upper portion of said frame support structure with the first knee pad follower above the first knee pad pivot, and where the first knee pad follower alternately travels toward the lower portion of said frame support structure with the first knee pad follower below the first knee pad pivot.

13. The sitting and kneeling apparatus of claim 10, wherein said frame support structure comprises a motor for alternately driving the first knee pad follower toward the upper portion of said frame support structure with the first knee pad follower above the first knee pad pivot, and where the first knee pad follower alternately travels toward the lower portion of said frame support structure with the first knee pad follower below the first knee pad pivot.

14. The sitting and kneeling apparatus of claim 10, comprising a substantially vertical back cushion positioned above and behind said substantially horizontal seat cushion.

15. The sitting and kneeling apparatus of claim 10, comprising a pair of substantially horizontal arm rests above said tiltable substantially horizontal seat cushion and extending outwardly with respect to said substantially vertical back cushion.

16. The sitting and kneeling apparatus of claim 10, comprising a pair of arm rests on opposite sides of said substantially horizontal seat cushion.

17. The sitting and kneeling apparatus of claim 10, wherein tilting said seat cushion and simultaneously moving a knee rest stored under said seat cushion to a position in front of said seat cushion for supporting the human being in a partial kneeling position.

18. The sitting and kneeling apparatus of claim 17, comprising a substantially vertical back cushion positioned above and behind said substantially horizontal seat cushion.

19. A sitting and kneeling method, comprising the steps of:

connecting a front portion and a rear portion of a seat cushion into a seat assembly;

supporting the seat assembly atop an upper portion a frame;

adjusting a height of the seat assembly from a lower portion the frame at a base thereof above a substantially horizontal floor surface for raising and lowering the frame with the seat assembly;

providing a first knee pad having a front portion and a rear portion for a deployed orientation where the front portion is above the rear portion with the front portion extending outwardly from the frame, and an inverted orientation where the front portion is below the rear portion for storage with the front portion near the base and the rear portion alongside the frame and below the seat assembly;

providing a second knee pad having a front portion and a rear portion;

connecting a first inverting knee assembly under the first knee pad where the first inverting knee assembly has a front end and a rear end, the first inverting knee pad assembly having a first knee pad pivot at the front end of the first inverting knee assembly and a first knee pad follower at the rear end of the first inverting knee assembly;

coupling a knee linkage at the first knee pad pivot with the upper portion of the frame below the seat assembly, with the first knee pad follower at a frame pathway on the frame for travel between the upper portion of the frame and the lower portion of the frame above the base; and moving the first inverting knee assembly for alternately positioning the first knee pad between the deployed orientation and the inverted orientation with the first knee pad follower traveling the frame pathway between the upper portion of the frame and the lower portion of the frame, and connecting a second inverting knee assembly connected under the second knee pad for moving with the first inverting knee assembly for alternately positioning the second knee pad between the deployed orientation and the inverted orientation with the second knee pad follower traveling the frame pathway between the upper portion of the frame and the lower portion of the frame.

20. The sitting and kneeling method of claim 19, providing a motor at the frame for alternately driving the first knee pad follower toward the upper portion of the frame with the first knee pad follower above the first knee pad pivot, and where the first knee pad follower alternately travels toward the lower portion of the frame with the first knee pad follower below the first knee pad pivot.

* * * * *